US007586087B2

(12) United States Patent
Dong et al.

(10) Patent No.: US 7,586,087 B2
(45) Date of Patent: Sep. 8, 2009

(54) METHODS AND APPARATUS TO CHARACTERIZE STOCK-TANK OIL DURING FLUID COMPOSITION ANALYSIS

(75) Inventors: Chengli Dong, Sugar Land, TX (US); Peter S. Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 228 days.

(21) Appl. No.: 11/738,156

(22) Filed: Apr. 20, 2007

(65) Prior Publication Data

US 2008/0173445 A1 Jul. 24, 2008

Related U.S. Application Data

(60) Provisional application No. 60/886,400, filed on Jan. 24, 2007.

(51) Int. Cl.
*G01V 8/00* (2006.01)

(52) U.S. Cl. ..... 250/255; 250/301

(58) Field of Classification Search ..... 250/255, 250/301

See application file for complete search history.

(56) References Cited

U.S. PATENT DOCUMENTS

| | | | | |
|---|---|---|---|---|
| 3,859,851 | A | 1/1975 | Urbanosky | |
| 4,860,581 | A | 8/1989 | Zimmerman et al. | |
| 4,936,139 | A | 6/1990 | Zimmerman et al. | |
| 4,994,671 | A | 2/1991 | Safinya et al. | |
| 5,167,149 | A | 12/1992 | Mullins et al. | |
| 5,201,220 | A | 4/1993 | Mullins et al. | |
| 5,226,800 | A | 7/1993 | Morino | |
| 5,331,156 | A | 7/1994 | Hines et al. | |
| 5,859,430 | A * | 1/1999 | Mullins et al. | 250/255 |
| 5,939,717 | A * | 8/1999 | Mullins | 250/255 |
| 6,956,204 | B2 | 10/2005 | Dong et al. | |
| 6,992,768 | B2 | 1/2006 | Dong et al. | |
| 7,081,615 | B2 | 7/2006 | Betancourt et al. | |
| 2006/0243047 | A1 | 11/2006 | Terabayashi et al. | |

OTHER PUBLICATIONS

Dong, C. et al., In-Situ Contamination Monitoring and GOR Measurement of Formation Fluid Samples, SPE 77899, 2002 SPE Asia Pacific Oil & Gas Conference and Exhibition (APOGCE), Melbourne, Australia, Oct. 8-10, 2002, pp. 1-9.

(Continued)

*Primary Examiner*—David P Porta
*Assistant Examiner*—Mark R Gaworecki
(74) *Attorney, Agent, or Firm*—Dave R. Hofman; Darla P. Fonseca; Jamie Castano

(57) ABSTRACT

Methods and apparatus to characterize stock-tank oil during fluid composition analysis are disclosed. A disclosed example method to characterize a fluid associated with an underground geological formation comprises obtaining a sample of the fluid associated with the underground geological formation, determining, in a borehole associated with the underground geological formation, a stock-tank oil type for the sample of the fluid associated with the underground geological formation, and determining a property of the fluid associated with the underground geological formation based on the stock-tank oil type.

25 Claims, 20 Drawing Sheets

OTHER PUBLICATIONS

Fujisawa, G. et al., Large Hydrocarbon Compositional Gradient Revealed by In-Situ Optical Spectroscopy, SPE 89704, Sep. 26-29, 2004, Houston, Texas, pp. 1-6.
Dong, C. et al., Downhole Measurement of Methane and GOR Content in Formation Fluid Samples, Feb. 2006 SPE Reservoir Evaluation and Engineering, pp. 1-13.
Del Campo, C. et al., Advances in Fluid Sampling with Formation Testers for Offshore Exploration, Offshore Technology Conference 18201, May 1-4, 2006, pp. 1-10.
Betancourt, S. et al., Exploration Applications of Downhole Measurement of Crude Oil Composition and Fluorescence, SPE 87011, Mar. 29-30, 2004, Malaysia, pp. 1-10.
Fujisawa, G. et al., Analyzing Reservoir Fluid Composition In-Situ in Real Time: Case Study in a Carbonate Reservoir, SPE 84092, Oct 5-8, 2003, Denver, pp. 1-9.
Mullins, O. et al., Hydrocarbon Compositional Analysis in-Situ in Openhole Wireline Logging, SPWLA 45th Annual Logging Symposium, Jun. 6-9, 2004, pp. 1-14.

* cited by examiner

Determine STO_TYPE

Table 1. Value of C1_f_GS[i].

| i (nm) | 1725 | 1740 | 1784 | 1798 | 1814 |
|---|---|---|---|---|---|
| C1_f_GS[i] | 0.5 | 0.45 | 0.21 | 0.22 | 0.16 |

Table 2. Value of wax_GS[i].

| i (nm) | 1725 | 1784 | 1798 | 1814 |
|---|---|---|---|---|
| wax_GS[i] | 1.428662 | 0.603271 | 0.55357 | 0.550159 |

Table 3. Value of b_alkane_GS[i].

| i (nm) | 1725 | 1784 | 1798 | 1814 |
|---|---|---|---|---|
| b_alkane _GS[i] | 1.264883 | 0.561781 | 0.464639 | 0.44747 |

if $\mathrm{GSOD_DC}[1740] - \mathrm{GSOD_DC}[1589] - \mathrm{C1_f_GS}[1740] * \frac{MR_{C1/C2+}}{MR_{C1/C2+}+1} \neq 0$ then //comments: compute C1 corrected and normalized GS1725, GS1784, GS1798, GS1814.

$$\mathrm{GSOD_NOR_C1}[i] = \frac{\mathrm{GSOD_DC}[i] - \mathrm{GSOD_DC}[1589] - \mathrm{C1_f_GS}[i] * \frac{MR_{C1/C2+}}{MR_{C1/C2+}+1}}{\mathrm{GSOD_DC}[1740] - \mathrm{GSOD_DC}[1589] - \mathrm{C1_f_GS}[1740] * \frac{MR_{C1/C2+}}{MR_{C1/C2+}+1}}$$

where i is the wavelength of GS channels at 1725nm, 1784nm, 1798nm and 1814nm. 1605

$$\text{temp1} = \sum_i (\mathrm{b_alkane_GS}[i] - \mathrm{GSOD_NOR_C1}[i]) \times (\mathrm{wax_GS}[i] - \mathrm{b_alkane_GS}[i])$$

where i is the wavelength of GS channels at 1725nm, 1784nm, 1798nm and 1814nm.

//comments: compute temp2

$$\text{temp2} = \sum_i (\mathrm{wax_GS}[i] - \mathrm{b_alkane_GS}[i])^2$$

where i is the wavelength of GS channels at 1725nm, 1784nm, 1798nm and 1814nm.

//comments: compute STO_ TYPE $$\mathrm{STO_TYPE} = \frac{-\text{temp1}}{\text{temp2}}$$ 1610 else

STO_TYPE = undefined end if return

FIG. 16

METHODS AND APPARATUS TO CHARACTERIZE STOCK-TANK OIL DURING FLUID COMPOSITION ANALYSIS

RELATED APPLICATIONS

This patent claims priority from U.S. Provisional Application Ser. No. 60,886,400, entitled "Characterize Stock Tank Oil Using Optical Signals to Improve Downhole Fluid Composition Analysis," filed on Jan. 24, 2007, and which is hereby incorporated by reference in its entirety.

FIELD OF THE DISCLOSURE

The present disclosure relates generally to methods and apparatus for making determinations regarding hydrocarbon bearing geological formations and, more particularly, to methods and apparatus to characterize stock-tank oil during fluid composition analysis.

BACKGROUND

Wells are generally drilled into the ground to recover natural deposits of hydrocarbons and/or other desirable materials trapped in geological formations in the Earth's crust. A well is drilled into the ground and/or directed to a targeted geological location and/or geological formation by a drilling rig at the Earth's surface.

Once a geological formation of interest is reached in a drilled well, drillers often investigate fluids of the geological formation (i.e., formation fluids) by taking fluid samples from the formation for analysis. In some examples, one or more formation fluid samples are obtained by lowering a fluid sampling tool into the well and withdrawing the fluid samples from an underground formation. One example of a sampling tool is the Schlumberger Modular Formation Dynamics Tester (MDT™). The fluid samples may then be analyzed (e.g., in a laboratory) to determine one or more characteristics of the fluid. Additionally or alternatively, characteristics of a fluid may be measured and/or the fluid may be analyzed (e.g., within the sampling tool itself and/or by a device communicatively coupled to the sampling tool) while the sample is relatively pristine. Moreover, such downhole fluid characterization and/or analysis provides information in substantially real-time in contrast to a laboratory analysis that may require many weeks or months to be completed, and/or surface well site analysis, which may result in undesirable phase transitions as well as the loss of key constituents. if the sampling pressure is above the saturation pressure, the fluid will most likely be in a single phase ensuring that the original composition is being analyzed. For pressures below the saturation pressure, a measurement of the properties of a liquid phase sample taken in the reservoir oil zone, and of an associated gas sample taken above the oil zone, will yield more accurate values than a measurement of the properties of a sample recombined at the surface. Indeed, it may be difficult to retain the sample recombined at the surface. Indeed, it may be difficult to retain the sample in the state in which it existed downhole when it is retrieved and/or removed to the surface.

Petroleum oil and gas are essentially a mixture of several hydrocarbon components, the variation of which dictates the characteristics of the fluid, along with some inorganic substances. Different types of reservoir fluids include black oils volatile oils, retrograde condensates, wet gases, and dry gases, and the different fluid types require different considerations for their exploitation, and different properties are used for their description. For example, it is generally agreed that black oils can be described satisfactorily using averaged properties of the oil and gas phases, such as the volumetric factors and gas solubility ratios. volatile oils and retrograde condensates, which are near critical fluids, as well as wet gases all require a more detailed knowledge of the fluid composition because the ultimate recovery will be dictated by the control of the production conditions (e.g., primarily pressure).

The analysis of a collected fluid sample provides information about the contents of the fluid, density, viscosity, saturation pressure (e.g., bubble point pressure or dew point pressure), and other important characteristics. This vital information is used for field planning decisions and/or for the optimization of upstream and/or downstream production facilities. Indeed, decisions such as the type of well completion, production procedures and the design of the surface handling and processing facilities are affected by the characteristics of the produced fluids. For example, if fluid in the well is a retrograde condensate, the saturation (dew) pressure, combined with the formation pressure and permeability, dictate the maximum pressure drawdown for production of the fluids, and/or whether an injection scheme for pressure maintenance for liquid vaporization should be implemented.

One fluid characteristic of particular interest is the gas-oil-ratio (GOR). The GOR is the ratio of the volume of the gaseous phase in the formation fluid and the volume of liquid hydrocarbons, at standard conditions (e.g., 60 degrees Fahrenheit and 1 atmosphere of pressure). GOR values are typically expressed in units of standard cubic feet of gas per barrel of oil (scf/bbl) at the standard conditions. The GOR, among other formation fluid parameters and/or values, is important in designing the upstream and/or downstream production facilities. for example, if the GOR is high, the surface facilities must be designed to handle a large amount of gas from the well.

SUMMARY

Example methods and apparatus to characterize stock-tank oil during fluid composition analysis are described. A disclosed example method to characterize a fluid associated with an underground geological formation includes obtaining a sample comprising the fluid associated with the underground geological formation; determining, in a borehole associated with the underground geological formation, a stock-tank oil type for the sample associated with the underground geological formation; and determining a property of the sample associated with the underground geological formation based on the stock-tank oil type.

another disclosed example method includes obtaining a sample of the fluid associated with the underground geological formation; detecting in situ indications of absorbance of light by the sample of the fluid; determining a stock-tank oil type for the sample of the fluid associated with the underground geological formation based on the detected indications; and determining a property of the fluid associated with the underground geological formation based on the stock-tank oil type.

yet another disclosed example method includes transmitting light to a sample of an underground geological formation; measuring an indication of absorption of the transmitted light by the sample; and comparing the measured indication of absorption to two or more absorptions for respective ones of two or more hydrocarbon types to determine a parameter of the sample, wherein the two or more hydrocarbon types include at least a waxy hydrocarbon and a non-waxy hydrocarbon.

A disclosed example apparatus to characterize a fluid associated with an underground geological formation includes a device to obtain a sample of the fluid associated with the underground geological formation; an optical sensor to measure an optical property of the sample of the fluid; and an analyzer to determine a stock-tank oil type for the sample of the fluid based on the optical property.

BRIEF DESCRIPTION OF THE DRAWINGS

FIG. 16 illustrates example instructions that may be implemented to determine an STO type for a fluid associated with an underground geological formation.

DETAILED DESCRIPTION

Figure 1:
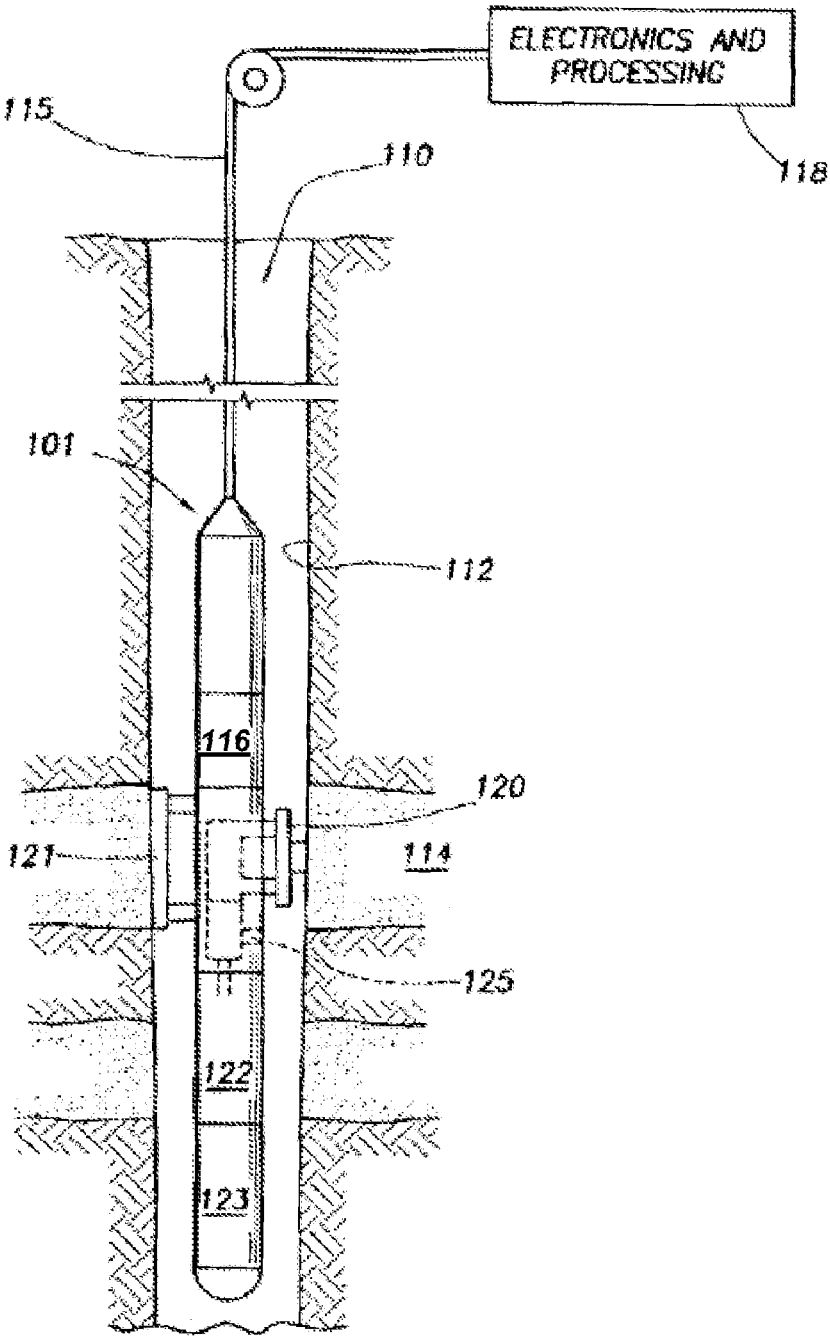
FIG. 1 illustrates a cross-section of an example geological formation testing tool constructed in accordance with the teachings of the invention.

As described in greater detail below, determinations regarding hydrocarbon bearing geological formations may be made via the use of a sampling tool such as the Schlumberger Modular Formation Dynamics Tester (MDT™). To facilitate composition analysis of the collected fluids, the sample tool may implement and/or include a module to measure and/or utilize the absorption of light (i.e., optical densities) at one or more wavelengths of interest (e.g., in the visible and/or near infrared (NIR) regions). A collection of one or more optical densities at one or more wavelengths of interest is commonly referred to as an "absorption spectrum." Example modules include, but are not limited to, the Schlumberger Optical Fluid Analyzer (OFA™), The Schlumberger Live Fluid Analyzer (LFA™), and/or the Schlumberger Composition Fluid Analyzer (CFA™). Details of example sampling tools and/or example fluid analyzer modules may be obtained with reference to commonly owned U.S. Pat. No. 3,859,851 to Urbanosky, U.S. Pat. Nos. 4,860,581and 4,936,139 to Zimmerman et al, U.S. Pat. No. 4,994,671 to Safinya et al., U.S. Pat. No. 5,167,149 to Mullins et al., U.S. Pat. No. 5,201,220 to Mullins et al., U.S. Pat. No. 5,266,800 to Mullins et al., U.S. Pat. No. 5,331,156 to Hines et al., U.S. Pat. No. 6,956,204 to Dong et al., and U.S. Pat. No. 7,081,615 to Betancourt et al, and U.S. Patent Application No. 2006/0243047 to Terabayahsi et al., all of which are hereby incorporated by reference in their entireties.

Because different molecules present in a formation fluid exhibit different absorption spectra, the composition of the formation fluid can be determined from the measured optical densities. For example, optical densities may be used to determine a as-oil-ratio (GOR), and/or concentrations and/or mass fractions of methane $CH_4$ (C1); ethane $C_2H_6$ (C2); a group containing propane $C_3H_8$, butane i-$C_4H_{10}$ and/or n-$C_4H_{16}$, and pentane i-$C_5H_{12}$ and/or n- $C_5H_{12}$ (C3-C5); a group containing hexane $C_6H_{14}$+ and heavier hydrocarbon components (C6+); and/or carbon dioxide ($CO_2$). However, the example methods and apparatus described herein may be more generally applied to any desired groupings, partitioning and/or characterization of fluid components. For example, the grouping C3-5 may be split into two or more separate groups, and/or C2 and C3-5 may be combined into a C2-5 group. Further, if desired, each component of a fluid may be considered separately to potentially increase precision of the modeling.

The accuracy of fluid composition analysis may depend upon the type of STO present in a fluid sample, thus, the example methods and/or apparatus described herein estimate, calculate and/or determine the type of STO present in the fluid sample, and use the STO type during subsequent fluid composition analysis. For example, as described below, an STO type may be determined and/or estimated from one or more measured optical densities. As described herein, the measurement of optical densities and/or the determination of STO types are performed in situ (e.g., within and/or nearby a well and/or downhole). However, persons of ordinary skill in the art will readily appreciate that the methods and apparatus described herein to determine and use an STO type to improve the accuracy of fluid composition analysis may be performed elsewhere (e.g., in a laboratory). As used herein, the term "stock-tank oil" refers to the liquid phase of a hydrocarbon after a live oil and/or condensate gas is flashed at standard conditions. Stock tank oils are comprise primarily of C6+ and small amounts of dissolved light hydrocarbons, and/or non-hydrocarbon gases like $CO_2$ and/or nitrogen. As use herein, the term "live oil" refers to a liquid hydrocarbon that contains dissolved hydrocarbon gases, such as methane and/or ethane.

FIG. 1 shows a cross-section of an example geological formation testing tool 101 designed to withdraw, measure characteristics of, and/or analyze a fluid sample present in a geological formation 114. The example testing tool 101 of FIG. 1 may be used to, among other things, implement the example fluid characterization methods and apparatus described herein. The example tool 101 is suspended in a borehole (i.e., a well) 110 from the lower end of a conveyance 115 such as wireline or multiconductor cable, that is spooled from the surface However, other types of conveyances 115 may be used. At the surface, the example wireline 115 is typically connected to an example controller and/or processing system 118 that monitors and/or controls the tool 101. The example controller and/or processing system 118 of FIG. 1 and/or a controller and/or processing system 116 implemented by and/or within the tool 101 may, additionally or alternatively, perform fluid composition analysis based on one or more measurements (e.g., optical densities) made by and/or within the sampling tool 101 (e.g., by a fluid analyzer module 125). As will be appreciated by those skilled in the art, the example controllers 116 and 118 of FIG. 1 may include one or more microprocessors or other processors or processing units, associated memory, and other hardware and/or software. Example manners of implementing the example controllers 116 and 118 are described below in connection with FIGS. 2 and 26.

Once at a desired depth, the example tool 101 of FIG. 1 is used to obtain a formation fluid sample and/or make one or more measurements of a collected and/or passing fluid sample. The example tool 101 has any number and/or type(s) of probes, and/or fluid inlets and/or ports (one of which is designated at reference numeral 120), that is selectively extendable from the tool 101, as well as an anchoring member 121 on the opposite side of the tool 101 that is also selectively extendable. The example probe 120 of FIG. 1 extends from the tool 101 and seats against the borehole wall 112 so that the probe 120 is in fluid communication with the formation 114. The example tool 101 may also include one or more pumps (not shown) to pump formation fluids from the formation 114 into the tool 101 and/or to pump formation fluids from the tool 101 into the borehole 110.

Formation fluids sampled by the tool 101 may be contaminated with mud filtrate, that is, the formation fluids may be contaminated with a drilling fluid that seeps into the formation 114 during the drilling process. Thus, when fluids are withdrawn from the formation 114 they may initially include mud filtrate. In some examples, formation fluids are withdrawn from the formation 114 and pumped into the borehole 110 or into a large waste chamber in the tool 101 until the fluid being withdrawn becomes sufficiently clean. A clean sample is one where the concentration of mud filtrate in the sample fluid is acceptably low so that the fluid represents native (i.e., naturally occurring) formation fluids. Once the fluid being withdrawn becomes sufficiently clean, a sample fluid may be analyzed, measured and/or collected for analysis.

Formation fluid withdrawn from the formation 114 by the example probe 120 of FIG. 1 may be passed through a fluid analyzer 125 before it is pumped out of the tool 101 and into the borehole 110 by a pump (not shown) and/or during sample collection. An example fluid analyzer 125 is an optical sensor (e.g., a gas and/or liquid analyzer spectrometer), which measures the absorption of light (e.g., the optical density (OD)) of the sample fluid at several (e.g., ten or twenty) different wavelengths (e.g., in the visible and/or NIR regions). An example set of wavelengths is {445 nanometers (nm), 570, nm, 647 nm, 680 nm, 815 nm, 1070 nm, 1290 nm, 1445 nm, 1500 nm, 1600 nm, 1650 nm, 1671 nm, 1690 nm, 1725 nm, 1760 nm, 1800 nm, 1930 nm, 1985 nm, 2010 nm, 2040 nm}. An example set of more finely spaced wavelengths occurring with a narrower range of wavelengths of interest is {1589 nm, 1603 nm, 1618 nm, 1634 nm, 1649 nm, 1665 nm, 1680 nm, 1695 nm, 1710 nm, 1725 nm, 1740 nm, 1755 nm, 1770 nm, 1784 nm, 1798 nm, 1814 nm}.

As described more fully below, measured OD values may be used to determine, calculate and/or estimate a type of STO present in a formation fluid and/or fluid sample, and/or to perform fluid composition analysis based upon an estimated STO type. As illustrated below in connection with FIGS. 10 and 11, by estimating an STO type and then using the estimated STO type during subsequent fluid composition analysis and/or GOR value computation, the accuracy of the fluid analysis performed (e.g., by, at and/or nearby the example sample tool 101) is substantially improved. While the example methods and apparatus described herein utilize OD values as indicators of light absorption, persons of ordinary skill in the art will readily appreciate that other type(s) of absorption indications may be used. For example, attenuative refractometry values, light emission values, fluorescence values, etc. Moreover, any other types of measurements (e.g., density and/or viscosity) may be used instead of, or in addition to, measured OD values. For example, waxy STO and non-waxy STO have different viscosities and, thus, a measured viscosity may be used to determine an STO type. Further, while the example methods and apparatus describe herein perform STO type determinations and/or perform fluid analysis based on measured OD values for sampled fluids, persons of ordinary skill in the art will readily appreciate that STO type determinations and/or fluid analysis may be performed using other types of measurements performed, and/or measurements taken for other types of samples. For example, the fluorescence of and/or the light refraction of a rock (e.g., the wall 112 of the formation 114, and/or a core and/or a sample taken from the borehole 110 and/or the formation 114) may be used to determine an STO type.

Additionally or alternatively, the measured OD values may also be used to determine the level of mud filtrate contamination. For example, because the oil used in an oil-based mud (OBM) is typically lighter in color than the relatively darker native formation fluid, the OD at the color channels increases asymptotically as the formation fluid becomes cleaner.

Once the formation fluid being withdrawn through the probe 120 is sufficiently clean (i.e., substantially contaminate free), one or more samples may be taken by pumping the fluid sample into one or more sample chambers 122, 123. The formation fluid and/or the samples may also have one or more OD measurements taken and/or collected by the example fluid analyzer 125. The term "contaminate free" is used herein to mean a property of the native formation fluid, substantially free of contamination from, for example, mud filtrate. Thus, a contaminate free gas-oil-ratio (GOR) means the GOR of the formation fluid, with no or insignificant effect from for example, the mud filtrate. While it may be difficult in practice to obtain a fluid sample that is completely free of mud filtrate contamination, the goal is to determine the properties of the formation fluid. The term "apparent" is used here in to refer to the value of a measurement taken during a sampling process. Thus, the apparent GOR is the measured value of the GOR of a fluid sample that is collected from the formation. The apparent GOR may be influenced by mud filtrate or other contaminants.

Two types of absorption mechanisms contribute to measured optical densities for a fluid sample; electron excitation and molecular vibration mode excitation. Absorption by electron excitation occurs when the energy of incident light is transferred to excite delocalized pi electrons to anti-bonding states. This energy level typically corresponds to light in the visible to near infrared (NIR) range and gives a shade of color as a result. We simply refer this mode of absorption as color hereafter. Oils may exhibit different colors because they have varying amounts of aromatics, resins, and asphaltenes, each of which absorb light in the visible and NIR spectra. So-called "heavy oils" have higher concentrations of aromatics, resins, and asphaltenes, which give them dark colors. So-called "light oils" and condensate, on the other hand, have lighter, yellowish colors because thy have lower concentrations of aromatics, resins, and asphaltenes.

Molecular vibration absorption is the absorption of a particular frequency of light due to resonance of the chemical bonds in a molecule. While color absorption covers the visible and NIR spectrums, molecular vibration absorption occurs only at specific wavelengths for specific materials. For any given molecule, the wavelength at which vibration absorption occurs is related to the type of chemical bonds and the molecular structure. For example, oils have molecular vibration absorption peaks near wavelengths of 1200 nm, 1400 nm, and 1700 nm. Molecular vibration absorption is a function of the concentration of the particular substance, and it is not necessarily affected by the phase of the substance. For example, the magnitude of a methane absorption resonance peak (near 1670 nm) will be the same, regardless of whether the methane is in the gas phase or dissolved in the oil. In addition to, or instead of, these two types of absorptions, scattering may also effect he measured OD values. For example, incident light can be redirected (e.g., reflected) by particles suspended in a sampled fluid causing light scattering. Scattering may also occur for multiple-phase fluid flows, such as, an oil and water mixture, an oil and gas mixture, and/or a water and gas mixture. For example, incident light can be redirected at phase interfaces, thereby, causing light scattering.

One example type of optical sensor is the Schlumberger OFA™ module, which implements a spectrometer to measure the OD of a sample fluid at ten different wavelengths in the NIR and visible range (i.e., in ten different filter-array channels). Another example type of optical sensor is the Schlumberger LFA™ module, which differs from the OFA™ module in that the LFA™ module includes a methane channel at the wavelength of a "methane peak" and an oil channel at the wavelength of an "oil peak." A "methane peak" is a molecular vibration absorption peak of methane having a wavelength that corresponds to the resonance of the CH bond in a methane molecule. An example methane molecular vibration absorption peak is at a wavelength of about 1670 nm. The molecular vibration absorption occurs independently of the color of the fluid and independently of whether the methane is in the gas phase or dissolved in the formation fluid. Similarly, an "oil peak" is a molecular vibration absorption peak of oil, having a wavelength corresponding to the resonance of the combination of $CH_2$ and $CH_3$ groups in an oil molecule. An example oil peak is at a wavelength of about 1720 nm.

Yet another example type of optical sensor is the Schlumberger CFA™ module, which includes optical channels at specific frequencies to get a better estimate of the spectrum of gases present in a fluid sample. For example, a typical CFA™ module has a channel that corresponds to the resonance peak for molecular vibration absorption in carbon dioxide $CO_2$. A typical CFA™ module is able to determine mass concentrations of methane, non-methane gaseous hydrocarbons, carbon dioxide, and liquid hydrocarbons.

While an example downhole sampling tool 101 is illustrated in FIG. 1, one or more of the elements, components, modules and/or devices illustrated in FIG. 1 may be combined, divided, re-arranged, omitted eliminated and/or implemented in any of a variety of ways. Further, the example fluid analyzer 125, the example controllers 116 and 118 and/or, more generally, the example sampling tool 101 may be implemented by hardware, software, firmware and/or any combination of hardware, software and/or firmware. Further still, the example sampling tool 101 may include elements, components, modules and/or devices instead of, or in addition to, those illustrated in FIG. 1 and/or may include more than one or any or all of the illustrated elements, components, modules and/or devices.

Figure 2:
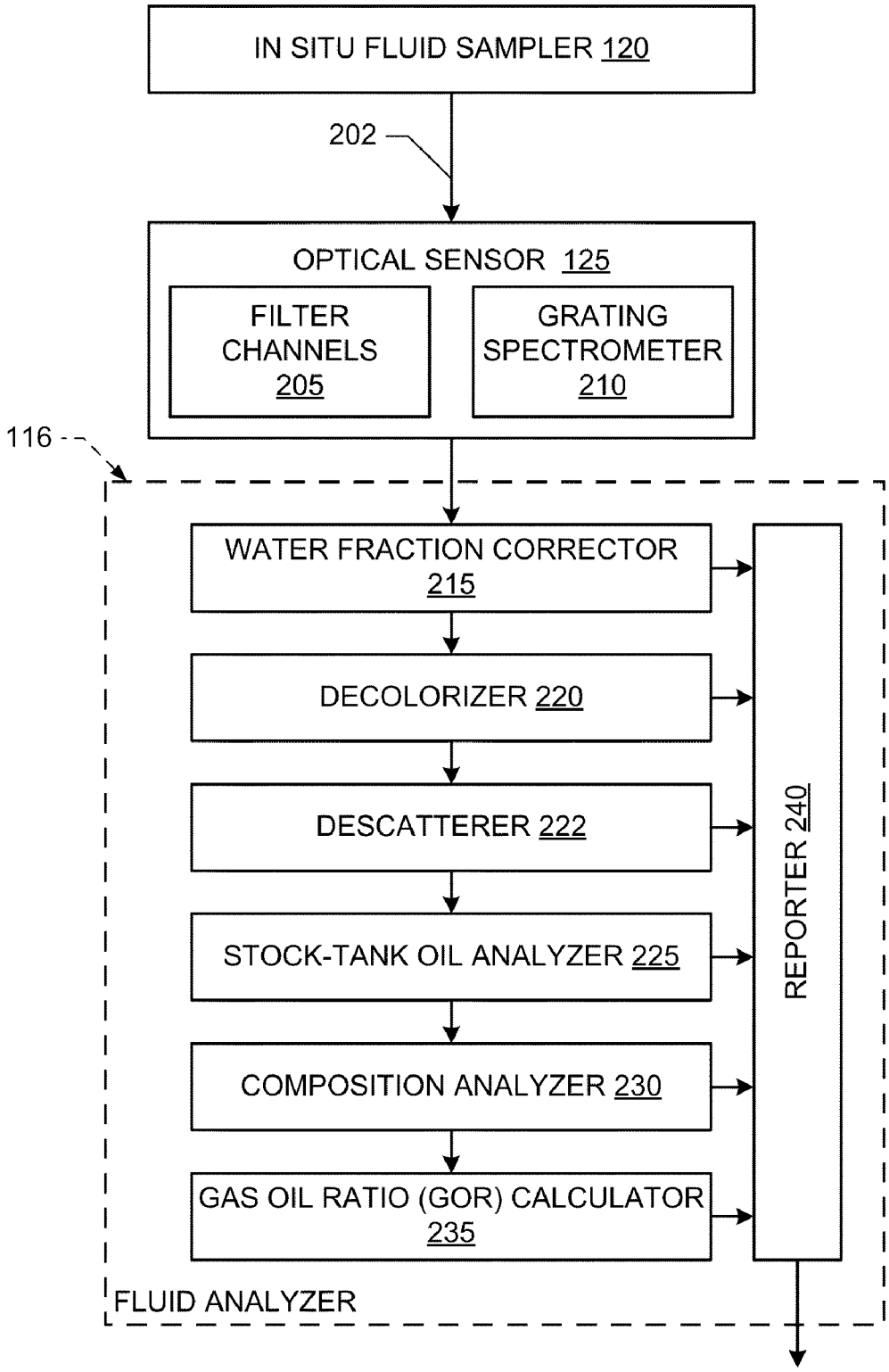
FIG. 2 illustrates an example manner of implementing any or all of the example controllers of FIG. 1.

FIG. 2 illustrates an example manner of implementing any or all of the example controllers 116 and 118 of FIG. 1. While any of the example controllers 116 and 118 of FIG. 1 may be represented by FIG. 2, for ease of discussion, the device of FIG. 2 will be referred to as fluid analyzer 116. The example fluid analyzer 116 of FIG. 2 receives OD values measured and/or collected by an optical sensor (e.g., any of the example fluid analyzers 125 discussed above in connection with FIG. 1) for a fluid sample 202 collected by an fluid sampler (e.g., the example probe 120 of FIG. 1). As illustrated in FIG. 2, the example optical sensor 125 may perform OD measurements using any number of filer channels 210 configured for a first set of wavelengths and/or OD measurements taken by a grating spectrometer 210 configured for a second set of wavelengths. In some examples, the first set of wavelengths (e.g., ten) implemented by the filter channels 210 represent a wider range of wavelengths than the second set of wavelengths (e.g., twenty) implemented by the grating spectrometer 210. The example fluid analyzer 116 of FIG. 2 uses one or more OD measurements taken by each of the filter channels 205 and the grating spectrometer 210 to estimate and then use an STO type during fluid composition analysis. However, the fluid analyzer 116 could use a different set of OD measurements taken at different wavelengths (e.g., from just the filter channels 205) to estimate and then use an STO type during fluid composition analysis.

To correct for water content, the example fluid analyzer 116 of FIG. 2 includes any type of water fraction corrector 215. Using any suitable method(s), algorithm(s), equation(s) and/or measurement(s), the example water fraction corrector 215 of FIG. 2 estimates the water volume fraction, and then uses the water value fraction to correct and/or adjust the OD values measured by the optical sensor 125. Example methods and apparatus to estimate and/or used water value fraction to correct and/or adjust measured OD values are described in commonly owned U.S. Pat. No. 6,992,768, entitled "Optical Fluid Analysis Signal Refinement," and which is hereby incorporated by reference in its entirety.

To correct for color absorption effects, the example fluid analyzer 116 of FIG. 2 includes any type of decolorizer 220. Using any method(s), algorithm(s), equation(s) and/or measurement(s), the example decolorizer 220 of FIG. 2 computes (e.g., estimates) the amount of color absorption in all channels (i.e., all wavelengths), and then adjusts the water corrected OD values based on the estimated amount of color absorption. Example methods and apparatus to estimate and/or correct for color absorption effects are described in commonly owned U.S. Pat. No. 6,992,768, entitled "Optical Fluid Analysis Signal Refinement."

To correct for scattering effects, the example fluid analyzer 116 of FIG. 2 includes any type of descatterer 222. Using any method(s), algorithm(s), equation(s) and/or measurement(s), the example descatterer 222 of FIG. 2 computers (e.g., estimates) the amount of scattering present in all channels (i.e., all wavelengths), and then adjusts the water corrected and/or color corrected OD values based on the estimated amount of scattering. Example methods and apparatus to estimate and/or correct for scattering effects are described in commonly owned U.S. Pat. No. 6,992,768, entitled "Optical Fluid Analysis Signal Refinement."

To estimate the type of STO present in the fluid sample 202, the example fluid analyzer 116 of FIG. 2 include a stock-tank oil analyzer 225. The example stock-tank oil analyzer 225 of FIG. 2 uses one or more OD values measured by the optical sensor 125, and possibly corrected by the example water fraction corrector 215, the example decolorizer 220 and/or the example descatterer 222, to determine, calculate and/or estimate the STO type. FIGS. 3-9 describe example fluid composition characteristics that may be utilized to determine an STO type. Example manners of implementing the example stock-tank oil analyzer 225 of FIG. 2 are described below in connection with FIGS. 15 and 16.

To perform composition analysis, the example fluid analyzer 116 of FIG. 2 includes a composition analyzer 230. The example composition analyzer 230 of FIG. 2 uses an STO type estimated by the example stock-tank oil analyzer 225 to identify the components contained in and/or estimate mass ratios of components contained in the fluid sample 202. An example manner of implementing the example composition analyzer 230 of FIG. 2 is described below in connection with FIG. 13.

To calculate (e.g., estimate) a GOR value for the fluid sample 202, the example fluid analyzer 116 of FIG. 2 includes a gas-oil-ratio calculator 235. Based on the composition analysis performed by the composition analyzer 230 and/or the STO type determined by the stock-tank oil analyzer 225, the example gas-oil-ratio calculator 235 estimate a GOR value for the fluid sample 202. An example manner of implementing the example gas-oil-ratio calculator 235 of FIG. 2 is described below in connection with FIG. 25.

To provide one or more of the values, parameters and/or properties estimated, determined and/or computed by the example fluid analyzer 116 of FIG. 2, the fluid analyzer 116 includes any type of reporter(s) 240. The example reporter 240 of FIG. 2 collects, receives and/or otherwise obtains values, parameters and/or properties that are estimated, determined and/or computed by the example water fraction corrector 215, the example decolorizer 220, the example descatterer 222, the example stock-tank oil analyzer 225, the example composition analyzer 230, and/or the example gas-oil-ratio calculator 235, and provides and/or outputs the same. For example, the reporter 240 may log, report, store (e.g., in a memory, a memory device and/or a storage device), add to a database and/or data structure, print (e.g., to piece of paper), display (e.g., on a display device), transfer, upload, communicate (e.g., via a communication, a data transfer and/or computer peripheral cable), and/or otherwise provide and/or output the obtained values, parameters, properties.

As illustrated below in connection with FIGS. 10 and 11, because the example fluid analyzer 116 of FIG. 2 estimates an STO type for the fluid sample 202 and then uses the estimated STP type during fluid composition analysis and/or GOR value computation, the accuracy of the fluid analysis performed by the example fluid analyzer 116 of FIG. 2 is substantially improved.

While an example manner of implementing any or all of the example controllers 116 and 118 of FIG. 1 has been illustrated in FIG. 2, one or more the elements, processes and devices illustrated in FIG. 2 may be combined, divided, rearranged, omitted, eliminated and/or implemented in any of a variety of ways. Further, the example water fraction corrector 215, the example decolorizer 220, the example descatterer 222, the example stock-tank oil analyzer 225, the example composition analyzer 230, the example gas-oil-ratio calculator 235, the example reporter 240 and/or, more generally, the example fluid analyzer 116 may be implemented by hardware, software, firmware and/or any combination of hardware, software and/or firmware. Further still, the example fluid analyzer 116 may include one or more elements, processes and/or devices in addition to, or instead of, those illustrated in FIG. 2, and/or may include more than one of any or all of the illustrated elements, processes and devices.

Given a set of OD values, the composition of various components of a fluid sample may be estimated. For example, a vector $\bar{c}$ that represents the concentrations of target components (e.g., methane (C1); ethane (C2); a group containing propane, butane, and pentane (C3-C5); a group containing hexane and heavier hydrocarbon components (C6+); and carbon dioxide ($CO_2$)) may be estimated by solving the mathematical expression of EQN (1), where $\bar{s}$ is a vector that contains the measured OD values for a set of optical channels (i.e., wavelengths), and $\hat{B}$ is a response matrix that represents the responses of each optical channel to the target components.

$$\bar{s}=\hat{B}\bar{c} \qquad \text{EQN (1)}$$

The response matrix $\hat{B}$ depends upon the type of STO present in a fluid sample. However, in many fluid composition analysis methods and apparatus currently employed, the STO type is unknown, imprecisely known and/or inaccurately known and, thus, the response matrix $\hat{B}$ used to perform fluid composition analysis for any particular fluid sample may be inaccurate. In such circumstances, any resulting fluid composition analysis may be likewise wholly or partially inaccurate.

Figure 3:
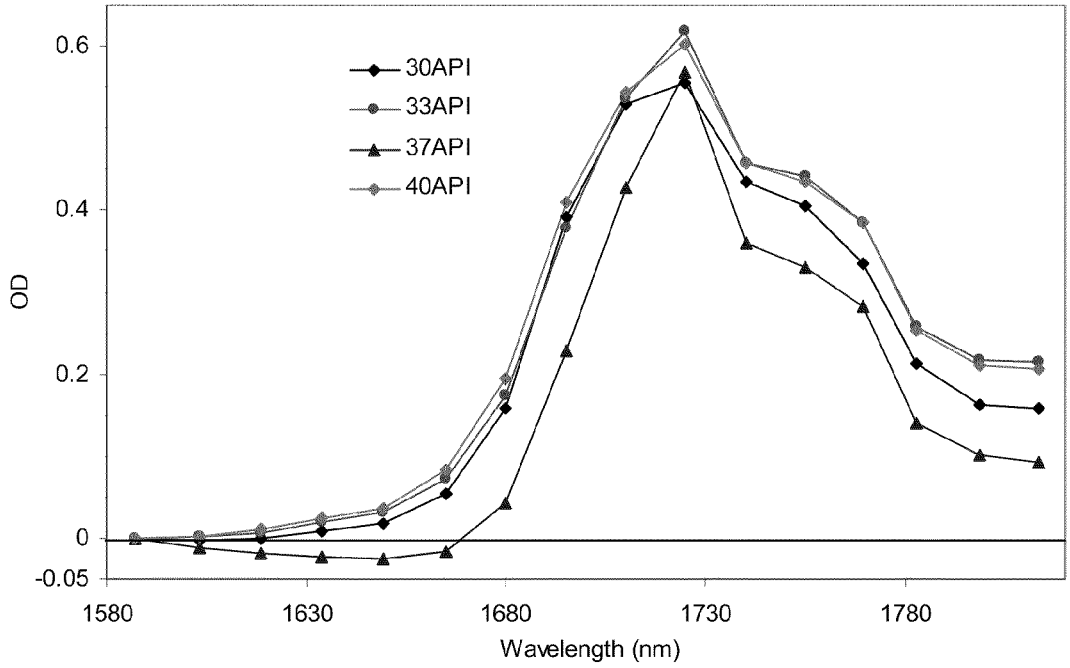
FIGS. 3, 4 and 5 illustrate example optical density value curves for various American Petroleum Institute (API) gravities, types of stock-tank oil (STO) and/or hydrocarbon components.

FIGS. 3, 4, 5, 7, 8 and 9 illustrate example fluid composition characteristics that may be recognized, utilized, employed and/or taken advantage of to determine an STO type for a fluid sample. FIG. 3 illustrates example OD values as a function of wavelength and STO American Petroleum Institute (API) gravity. As illustrated in FIG. 3, the spectrum of STO can vary significantly depending upon its type. Moreover, because of the large spectrum variation around channels 1650 nm and 1710 nm, not knowing the STO type may have a profound impact on the detection of light hydrocarbons (C1 through C5, i.e., C1-5) having main absorptions that fall in this band of wavelengths.

After a live oil is flashed, most volatile hydrocarbon components (C1-5) vaporize into their gaseous phase. In fact, substantially all of C1, C2 and $CO_2$ are in the gaseous phase after flashing. Thus, a flashed STO contains mainly non-volatile hydrocarbons (C6+). From the point of NIR spectroscopy, the major hydrocarbon components in STO may be classified into three types:

Saturated long-chain alkane with no or few branches. Wax is representative of hydrocarbons of this type, which are primarily straight long-chain alkanes with few branches, usually from C17 to C90+. For this type of hydrocarbon, the molecule structure is dominated by —$CH_2$— group, so its NIR spectroscopy shows strong character of —$CH_2$— absorption, like that of n-decane (nC10).

Saturated alkane with lots of branches. Typically, the more branches an alkane has, the more —$CH_3$ groups in molecule, so the branched alkanes contain more —$CH_3$ groups than the wax type of hydrocarbons. The molecular structures of the straight-chain nC10 and a branched C10 are shown below. Although both compounds have the same formula, $C_{10}H_{22}$, their molecular structures are significantly different, and the ratio of —$CH_3$ to —$CH_2$— group varies from 1:5 for the straight-chain C10 to 3:1 for the branched C10. Therefore, the NIR spectroscopy of the branched alkanes shows more characters of —$CH_3$ absorption in addition to —$CH_2$— absorption properties.

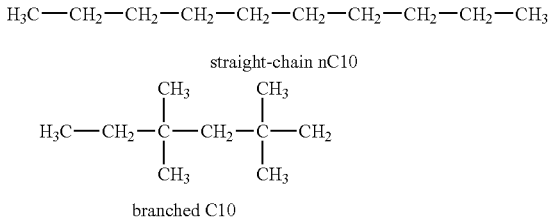

Aromatics hydrocarbons including resins and asphaltenes that contain benzene rings in their molecules. Because of the effect of the combined benzene rings, the NIR spectroscopy of asphaltene can be different than both the waxy and branched-alkane types of hydrocarbons.

Figure 4:
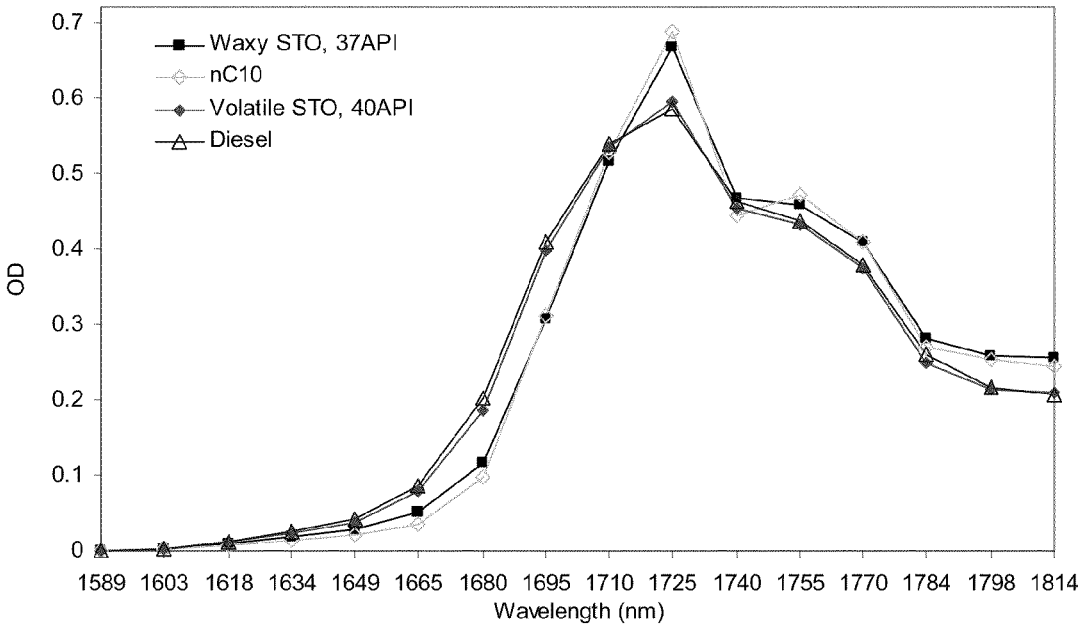

FIG. 4 illustrates example OD values for a very waxy STO and a non-waxy volatile STO. The waxy STO shows the characteristics of —$CH_2$— absorption, which substantially matches nC10 spectrum. On the other hand, the non-waxy volatile STO shows more characteristics of —$CH_3$ group, which substantially matches the spectrum of a diesel that contains large amount of branched alkanes.

Figure 5:
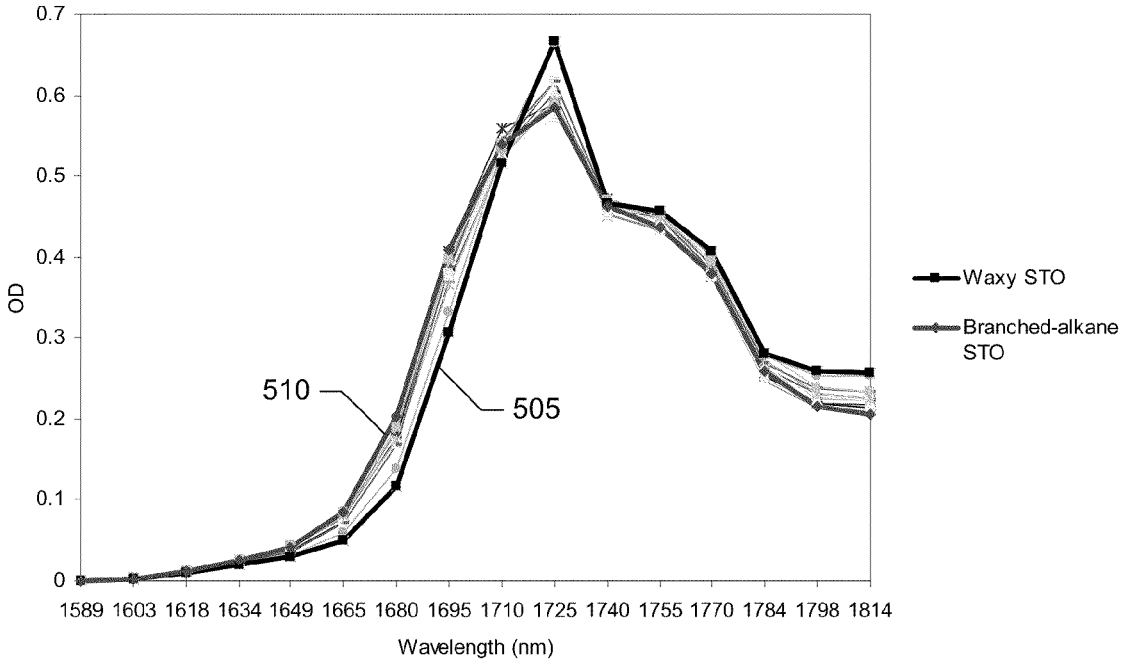

FIG. 5 illustrates example OD values for sixteen different types of STOs. A first thick curve 505 represents waxy STO and a second thick curve 510 represents diesel. The two curves 505 and 510 represent two extreme cases of STO spectrum; waxy type (—$CH_2$—) and branched-alkane type (—$CH_3$). The spectra of almost all other types of STO are between these two extreme cases, depending on the contents of wax and branched-alkane. The waxy type STO has strong absorptions at channels ranging from 1725 nm to 1814 nm and weak absorption at channels ranging from 1650 nm to 1710 nm. On the other hand, the branched-alkane type STO has weaker absorptions from 1725 nm to 1814 nm and stronger absorptions from 1650 nm to 1710 nm, which is opposite to the waxy type STO.

Figure 6:
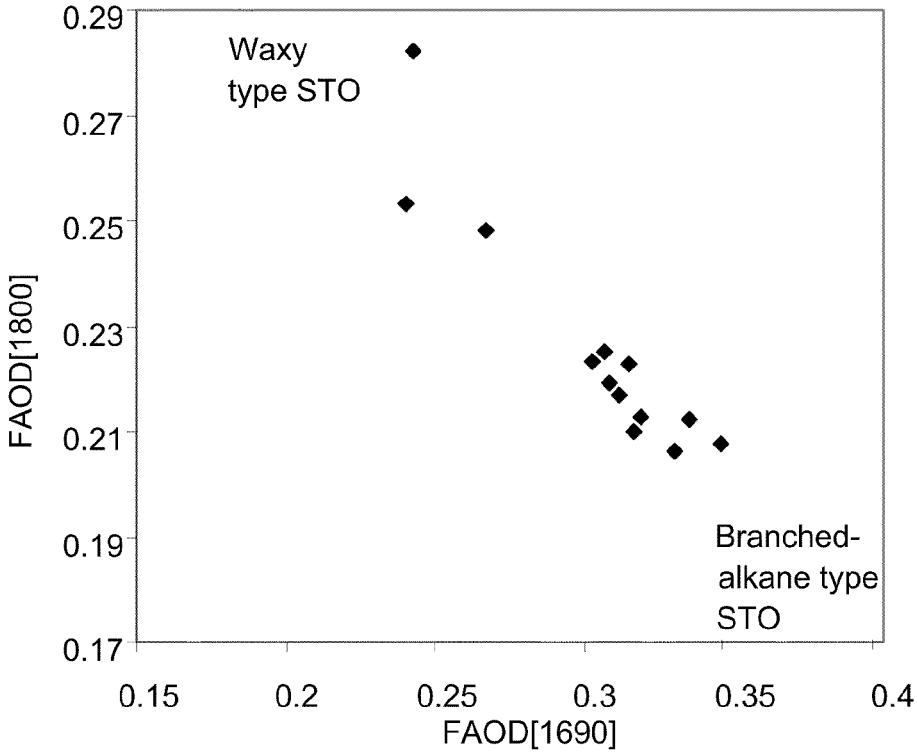
FIG. 6 illustrates example relationships between optical density values at 1690 nanometers (nm) and 1800 nm for different types of STO.

FIG. 6 shows the relationship between the channels 1690 nm and 1800 nm, as the STO type varies from the waxy type to the branched-alkane type. As illustrated in the examples of FIGS. 5 and 6, the STO type may be determined from the channels 1725 nm to 1814 nm, and the absorptions of the STO channels 1650 nm to 1710 nm may be determined and then used into account for composition analysis.

Figure 7:
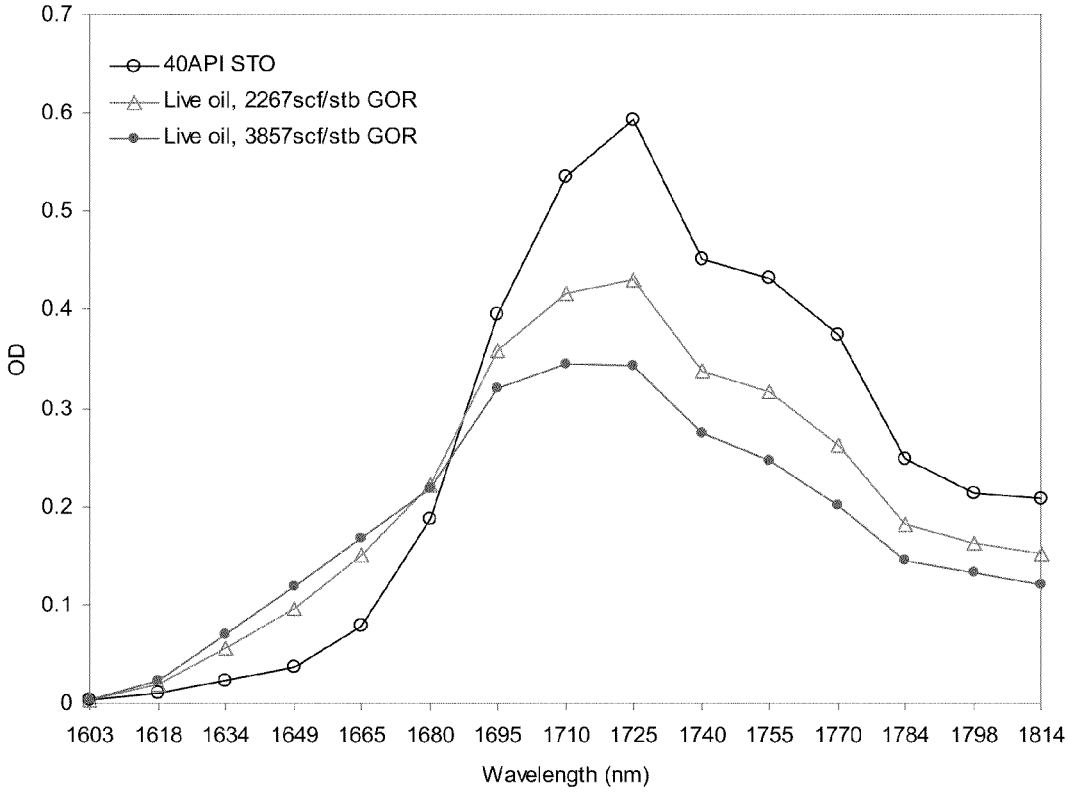
FIG. 7 illustrates example optical density value curves for a particular STO separately and when the STO occurs in a "live oil" at different gas-oil-ratios.

During fluid analysis and/or measurement (e.g., downhole), only OD values for the live oil are available. However, the spectrum of the live oil may be substantially different than the spectrum of the STO. FIG. 7 illustrates example OD values for a particular STO, and two live oils formed from the combination of the same STO and gas at different GOR values.

Figure 8:
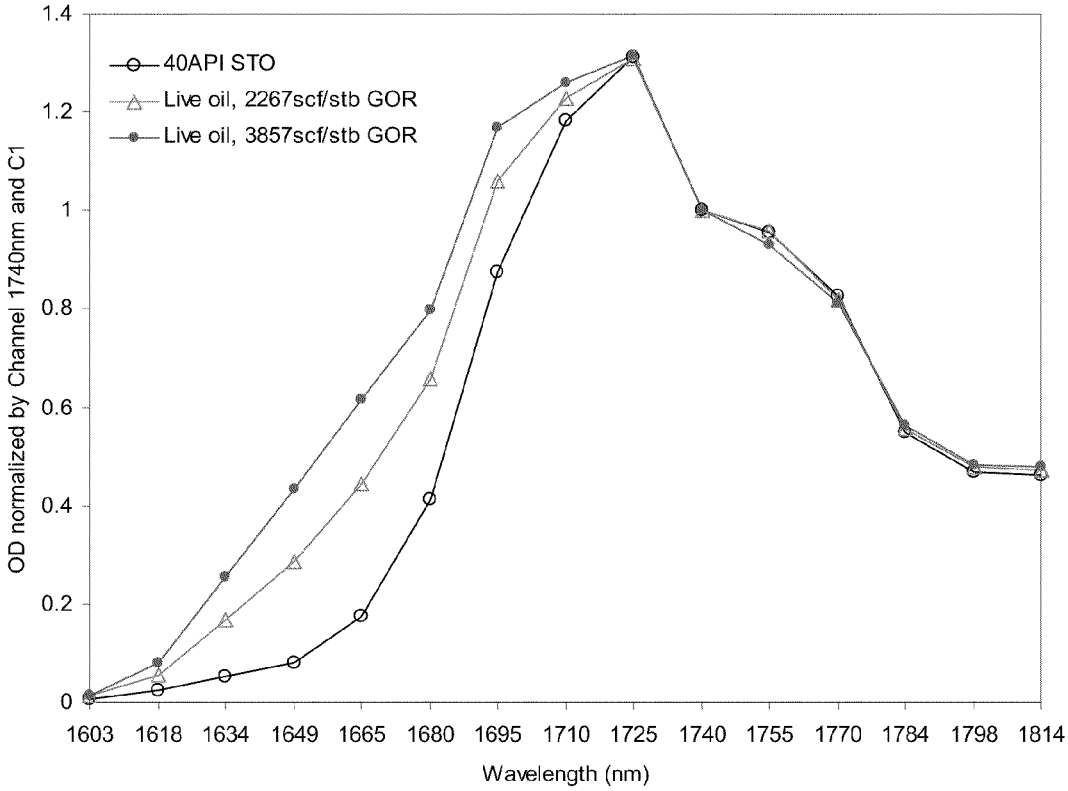
FIG. 8 illustrates the example optical density value curves of FIG. 7 after normalization by the optical density at 1740 nm and for methane (C1) content.

To determine an STO type based on a live-oil spectra, the live-oil spectra may be normalized by channel 1740 nm and for C1 content. FIG. 8 illustrates the example live-oil spectra of FIG. 7 after normalized by channel 1740 nm and for C1 content. Example instructions that may be carried out to normalize by channel 1740 nm and for C1 content is described below in connection with FIG. 16. In the illustrated example of FIG. 8, the normalized live-oil spectra are substantially similar for channels 1725 nm to 1814 nm, even when the content of C1 to C5 is more than 40 percent by weight. Therefore, as shown in FIG. 8, an STO type may be identified from channels ranging from 1725 nm to 1814 nm of the normalized live-oil spectrum.

For example, an STO type may be determined for a fluid sample using the following process:

1. Define normalized spectra of waxy and branched alkane STO, and define STO_TYPE values as:
   a. STO_TYPE=1 for a "pure" waxy oil
   b. STO_TYPE=0 for a "pure" branched alkane
2. Normalize measured live oil spectrum by channel 1740 nm and for C1 content
3. Use Channels 1725 nm to 1814 nm to compute STO_TYPE of the live oil so that $$OD[\lambda]_{Live\text{-}oil}=OD[\lambda]_{Waxy\text{-}STO}\times STO_TYPE+OD[\lambda]_{Branched\text{-}alkane\text{-}STO}\times(1-STO_TYPE)$$

where λ are the channel wavelengths ranging between 1725 nm to 1814 nm, $OD[\lambda]_{Live\text{-}oil}$ is the normalized measured live oil spectrum from the previous step, $OD[\lambda]_{Waxy\text{-}STO}$ is a normalized pre-defined waxy STO spectrum, and $OD[\lambda]_{Branched\text{-}alkane\text{-}STO}$ is a normalized pre-defined branched-alkane STO spectrum.

Figure 9:
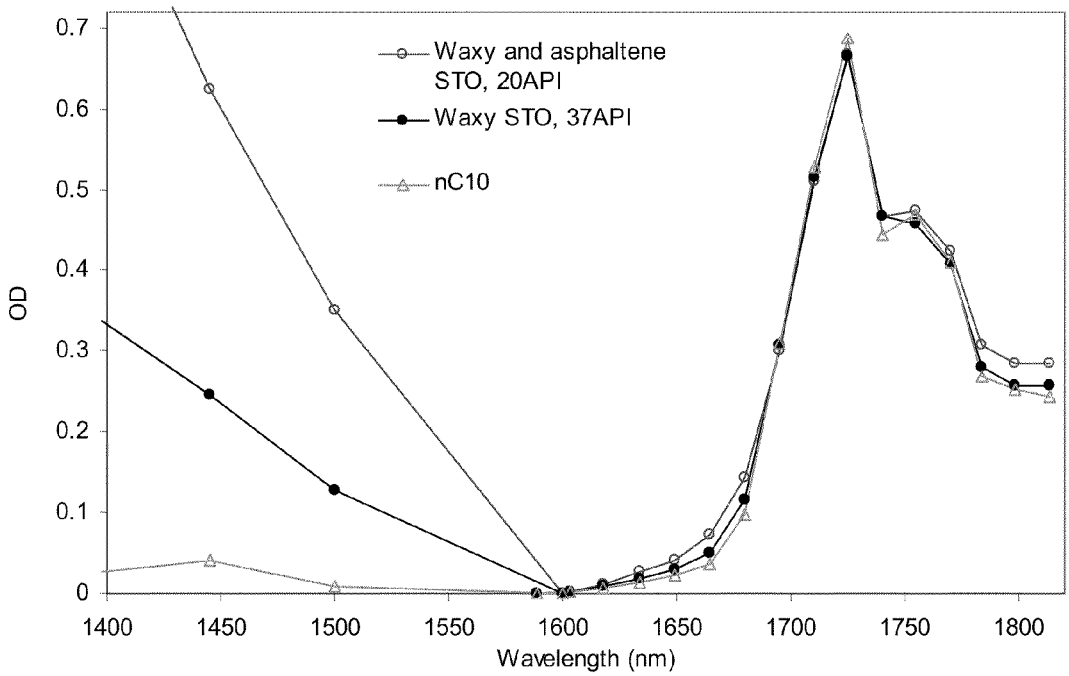
FIG. 9 illustrates example effects of asphaltene content and n-decane (nC10) content on STO optical density values.

In addition to the waxy and branched-alkane contents, asphaltene content in STO also affects its spectrum. FIG. 9 shows example OD values for a waxy STO, another waxy STO but with much more asphaltene and nC10 that contains no asphaltene. As illustrated in FIG. 9, as the asphaltene content increases, the absorption increases at channels 1650 nm to 1680 nm where C1 has the major absorption peak. If the effect illustrated in FIG. 9 is not corrected, a derived C1 content and/or a derived GOR value may be inaccurate.

Asphaltene molecules may cause color absorptions from the visible (400 nm to 700 nm) to the NIR regions. As shown in FIG. 9, the greater the asphaltene content of an oil, the strong its color absorptions. Thus, in some examples, the asphaltene effects on channels 1650 nm to 1680 nm are identified and corrected on the basis of the color absorptions.

Figure 10:
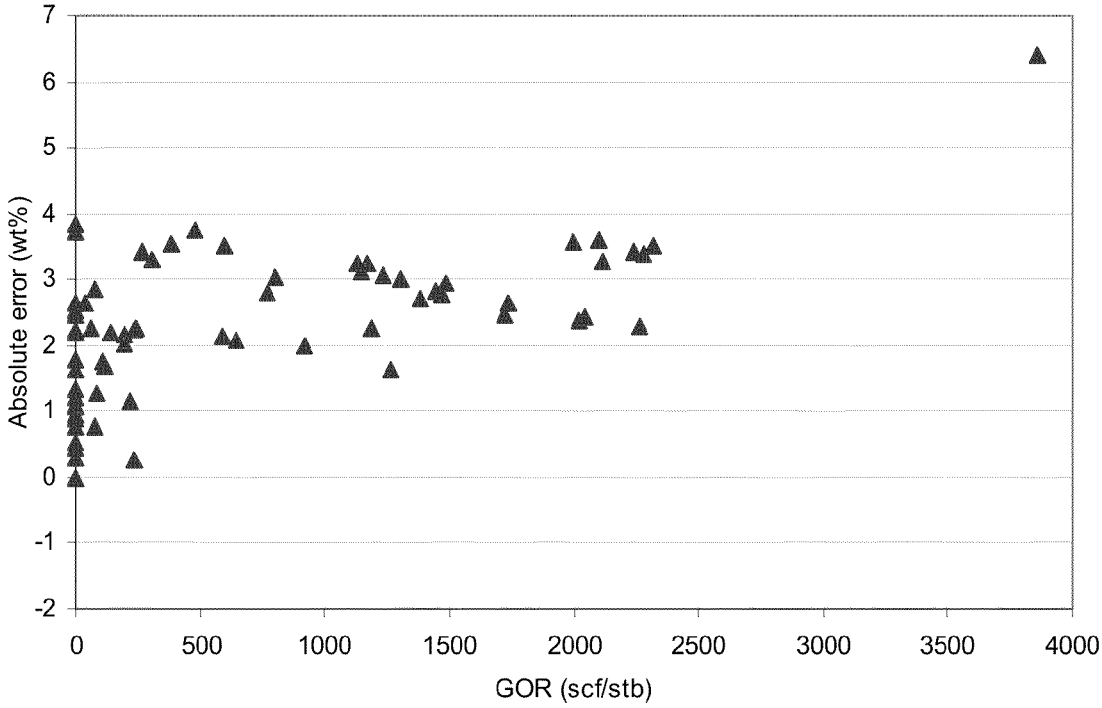
FIGS. 10 and 11 illustrate example improvements of downhole fluid composition analysis accuracy that may be achieved when an STO type is determined and then used during composition analysis.
Figure 11:
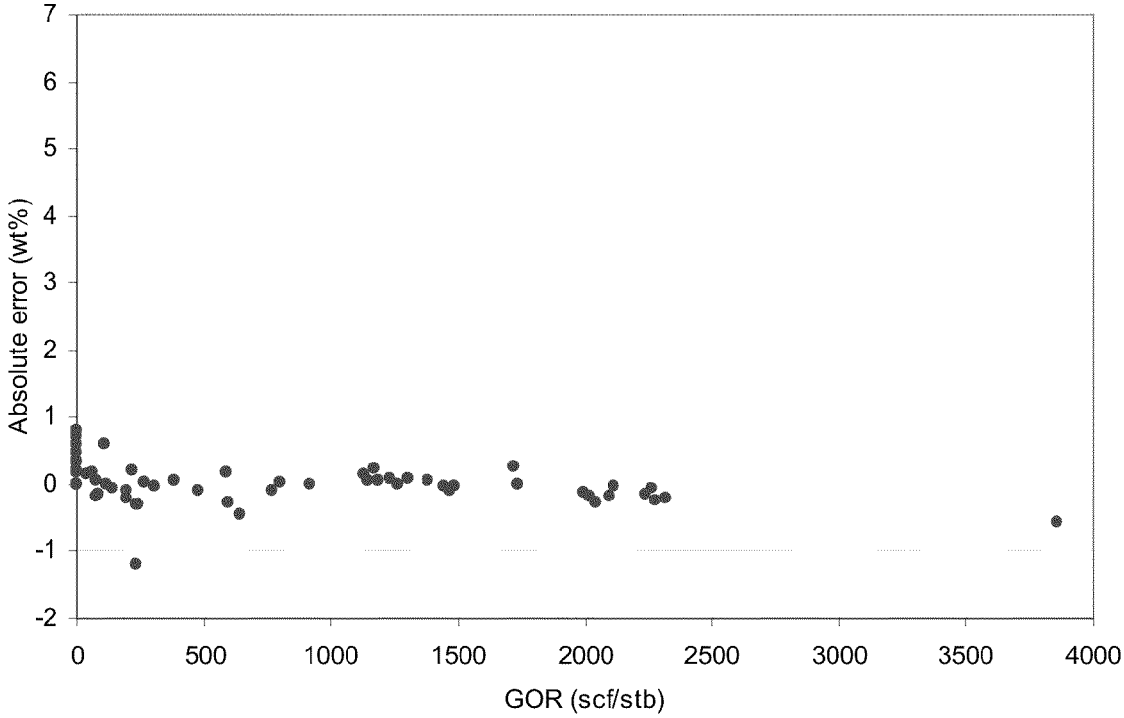

FIGS. 10 and 11 illustrate example improvements of downhole fluid composition analysis accuracy that may be achieved when an STO type is determined and then used during composition analysis. FIG. 10 illustrates example accuracy results achievable when an STO is not determined and used during analysis. FIG. 11 illustrates example accuracy results achievable when an STO is determined and then used during composition analysis. In the examples of FIGS. 10 and 11, the absolute errors in the estimate of C1 content are displayed for various fluid samples. As illustrated in FIGS. 10 and 11, determining an STO type and using the same during composition analysis greatly improves the average absolute error of the composition analysis (e.g., from approximately 3 percent to less than 0.5 percent).

Figure 12:
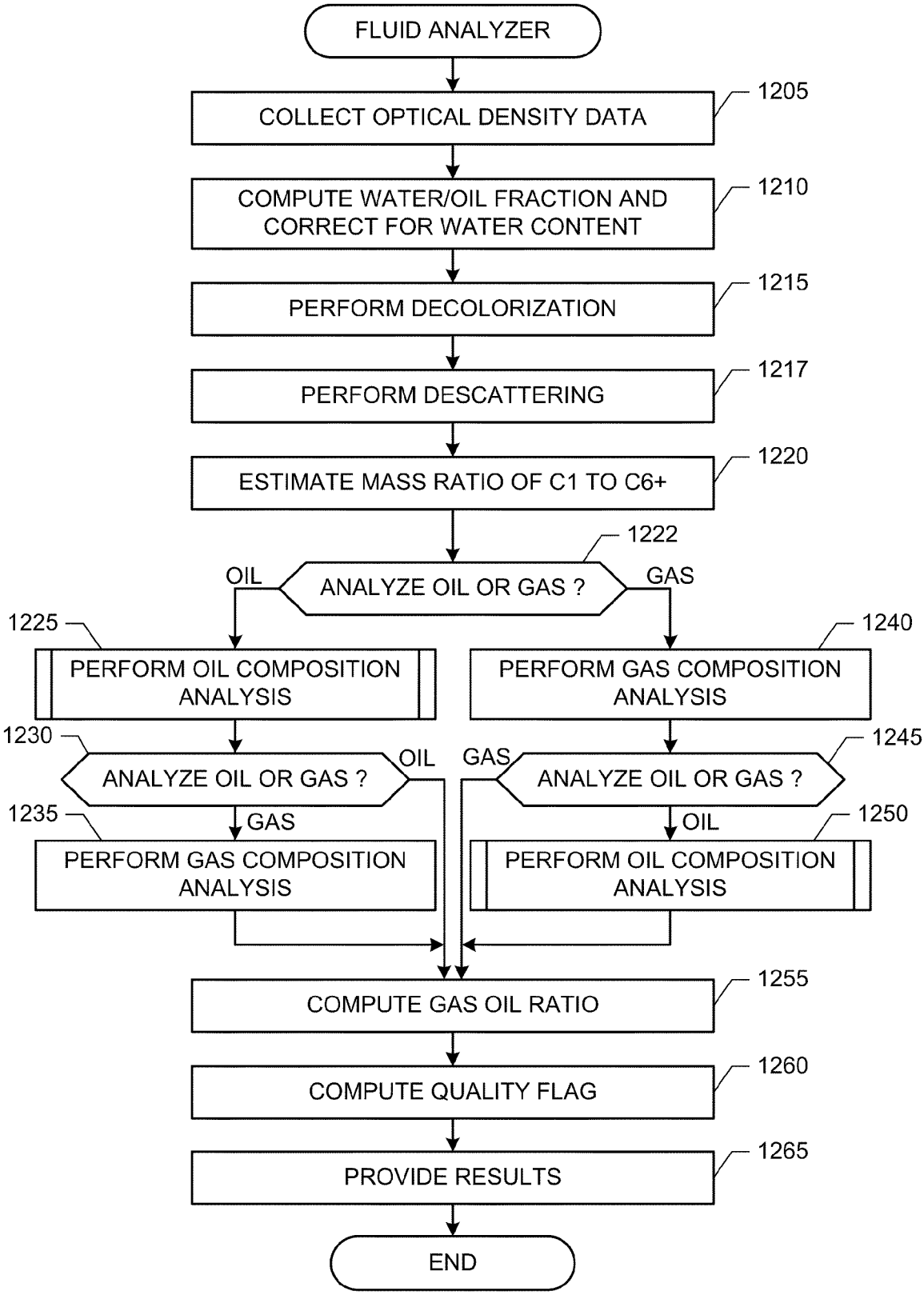
FIG. 12 is a flowchart representative of an example process that may be carried out to determine an STO type and then perform downhole fluid composition analysis based on the determined STO type and/or, more generally, to implement any or all of the example apparatus of FIGS. 1 and 2.
Figure 13:
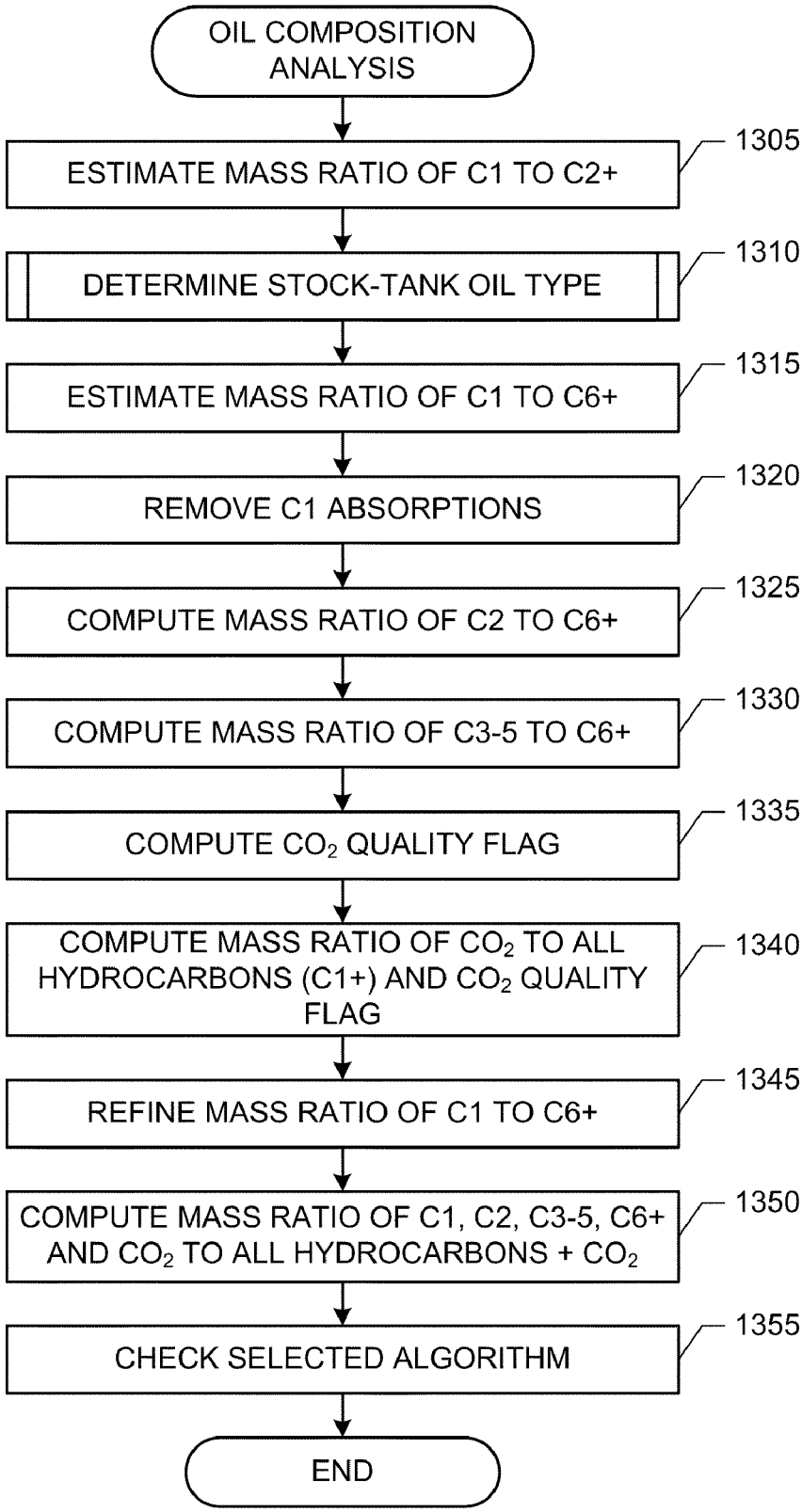
FIG. 13 is a flowchart representative of an example process that may be carried out to perform oil composition analysis for a fluid associated with an underground geological formation.
Figure 14:
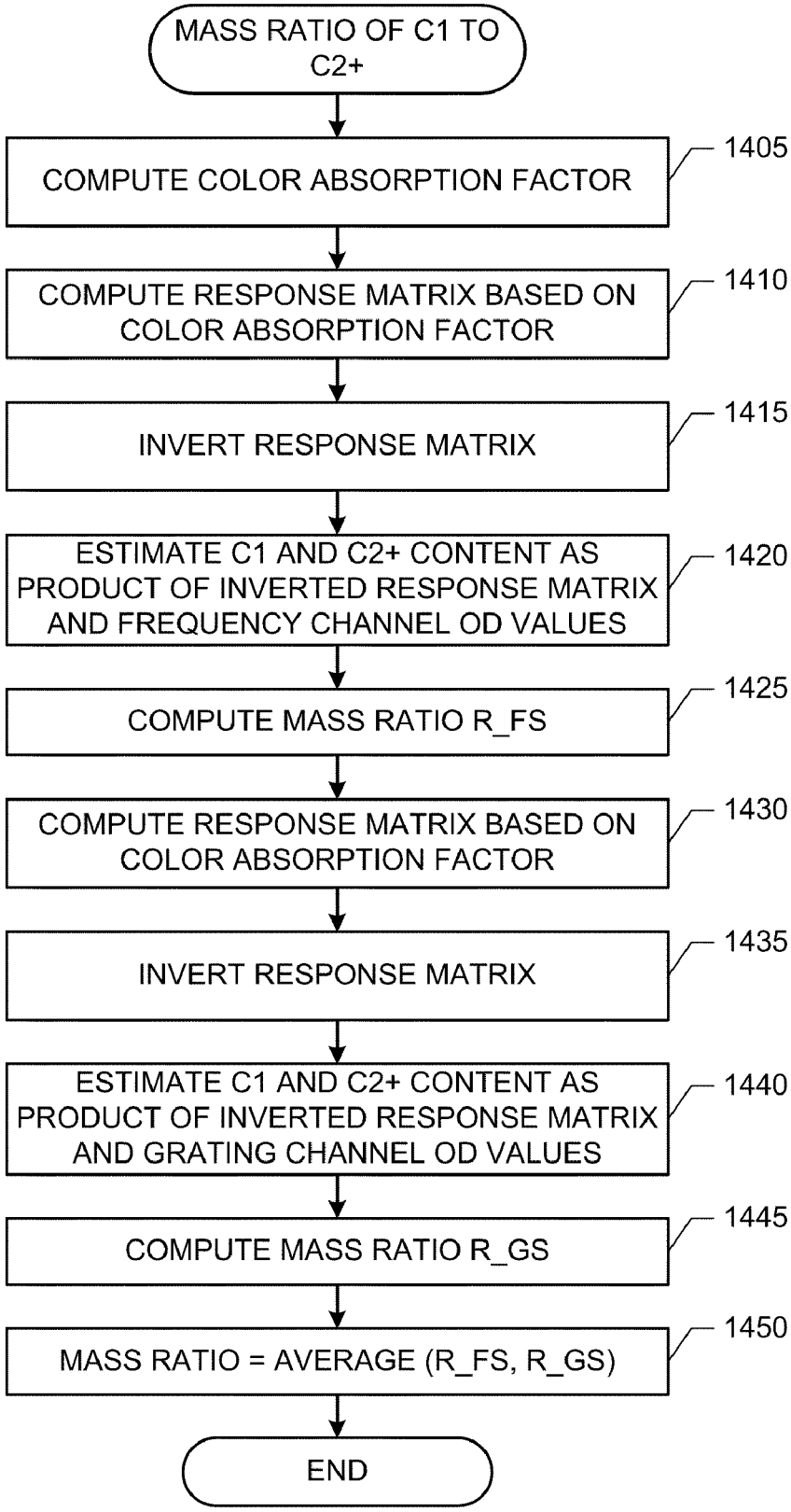
FIG. 14 is a flowchart representative of an example process that may be carried out to estimate the mass ratio of C1 to C2+.
Figure 15:
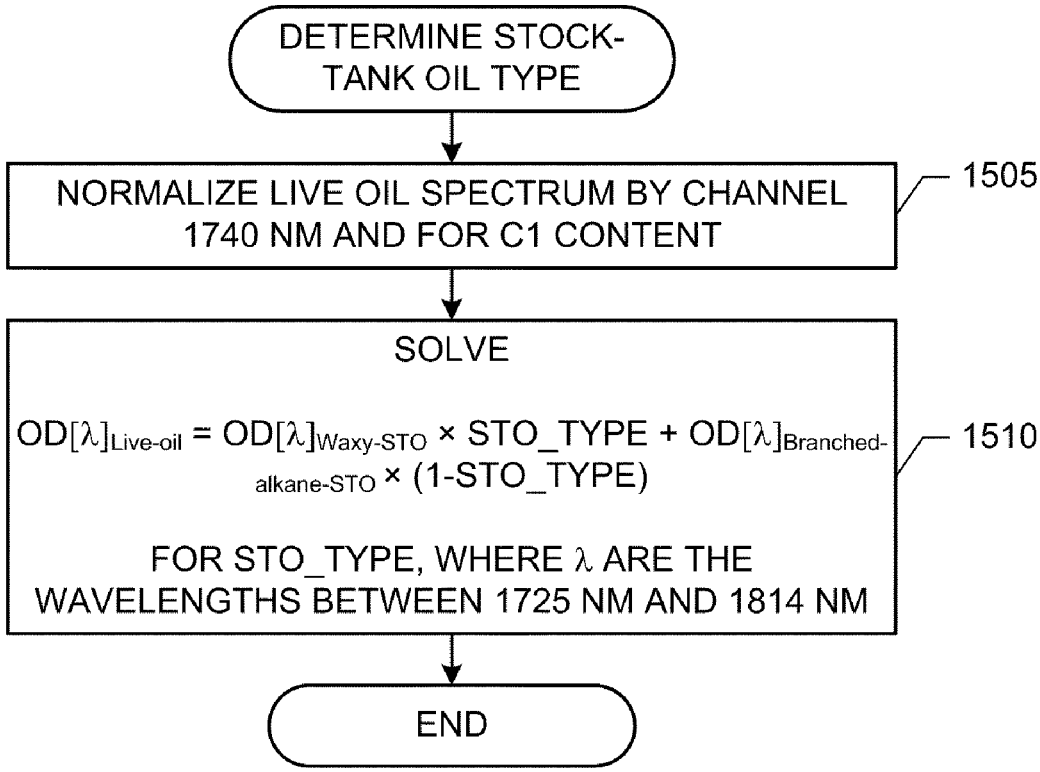
FIG. 15 is a flowchart representative of an example process that may be carried out to determine an STO type for fluid associated with an underground geological formation.
Figure 17:
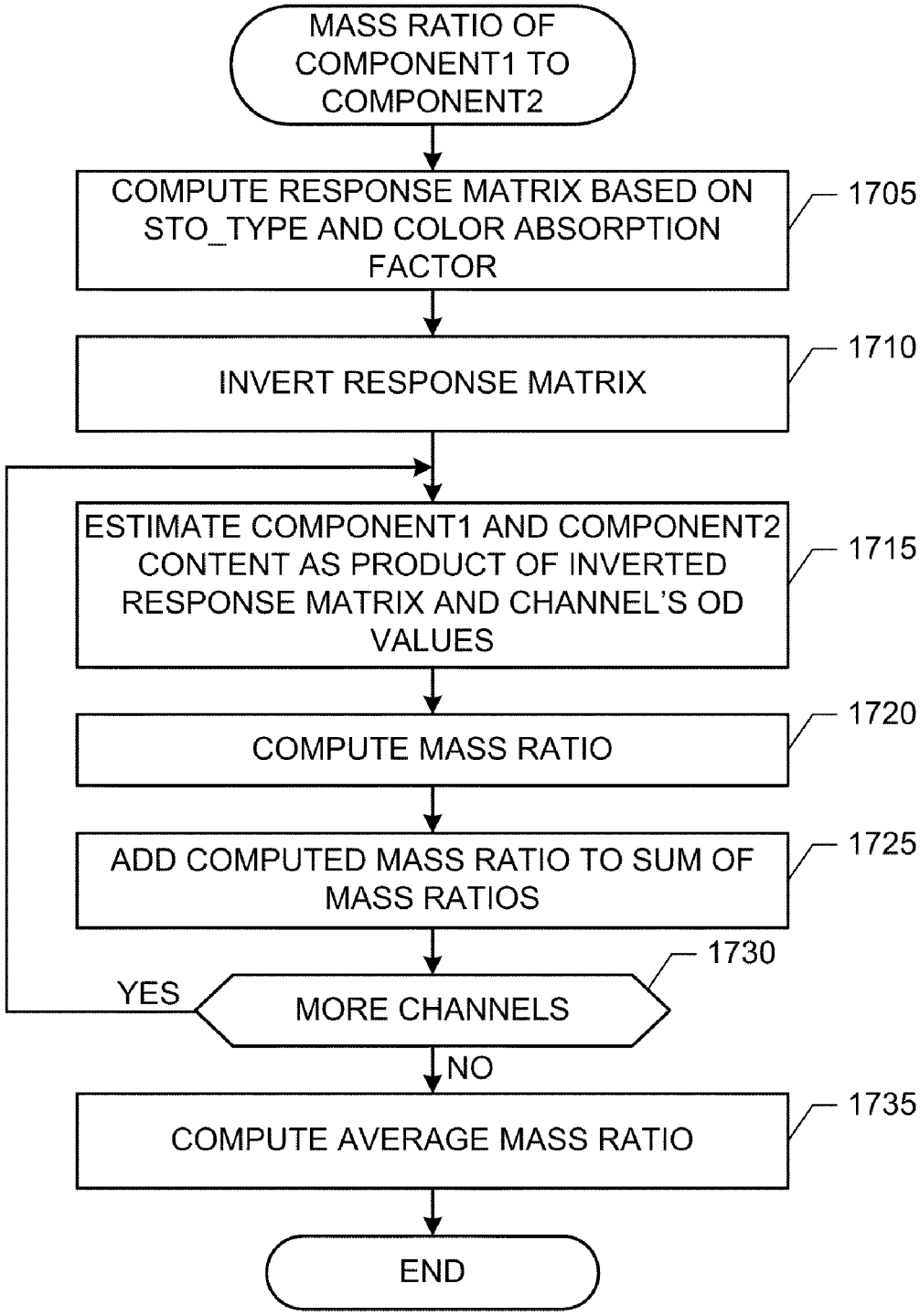
FIG. 17 is a flowchart representative of an example process that may be carried out to compute a mass ratio of two components.
Figure 18:
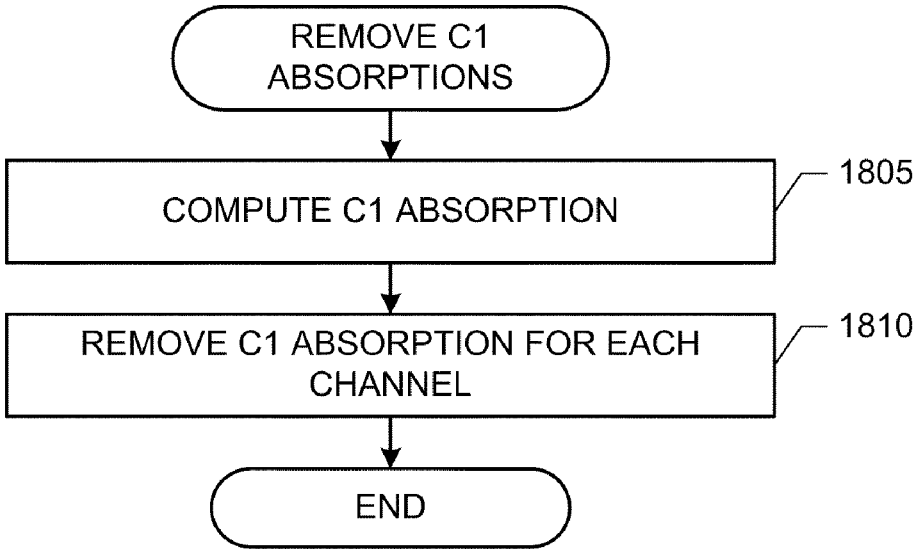
FIG. 18 is a flowchart representative of an example process that may be carried out to remove the affect of C1 absorptions.
Figure 19:
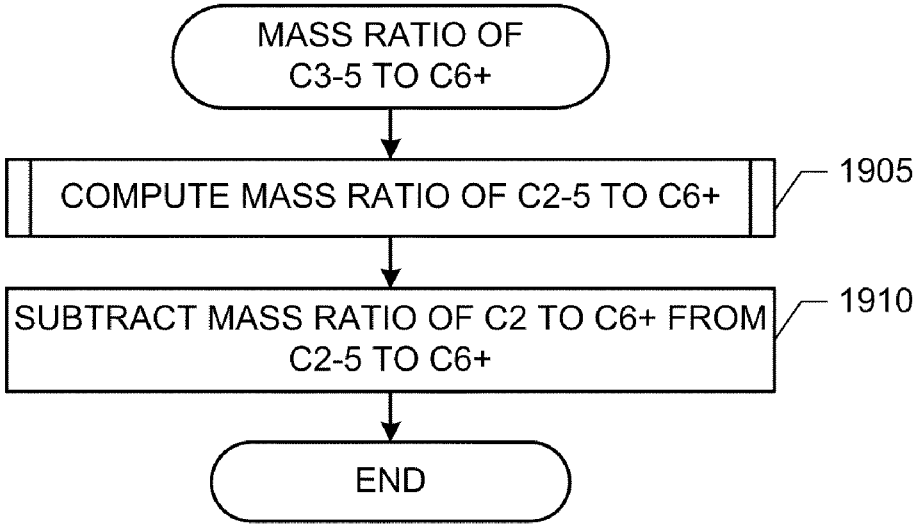
FIG. 19 is a flowchart representative of an example process that may be carried out to compute a mass ratio of C3-5 to C6+.
Figure 20A:
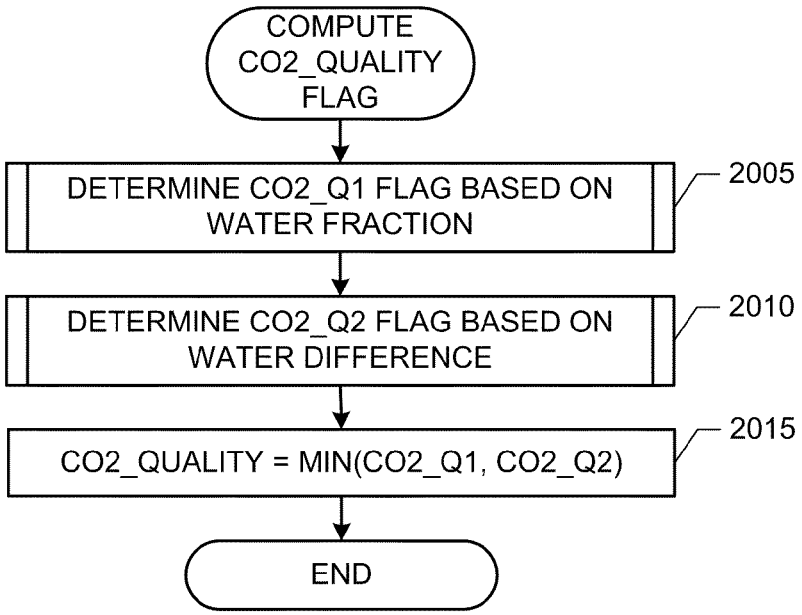
FIGS. 20A and 20 B are flowcharts representative of example processes that may be carried out determine to a $CO_2$ quality flag.
Figure 20B:
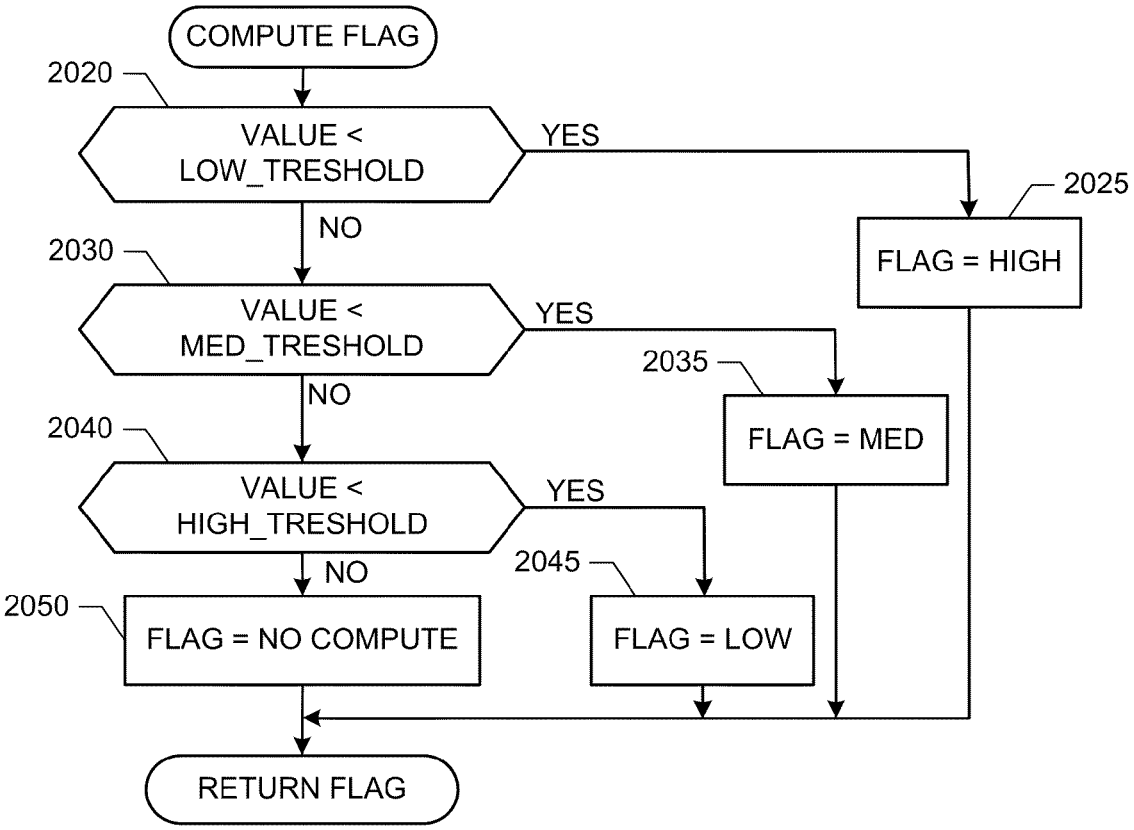
Figure 21:
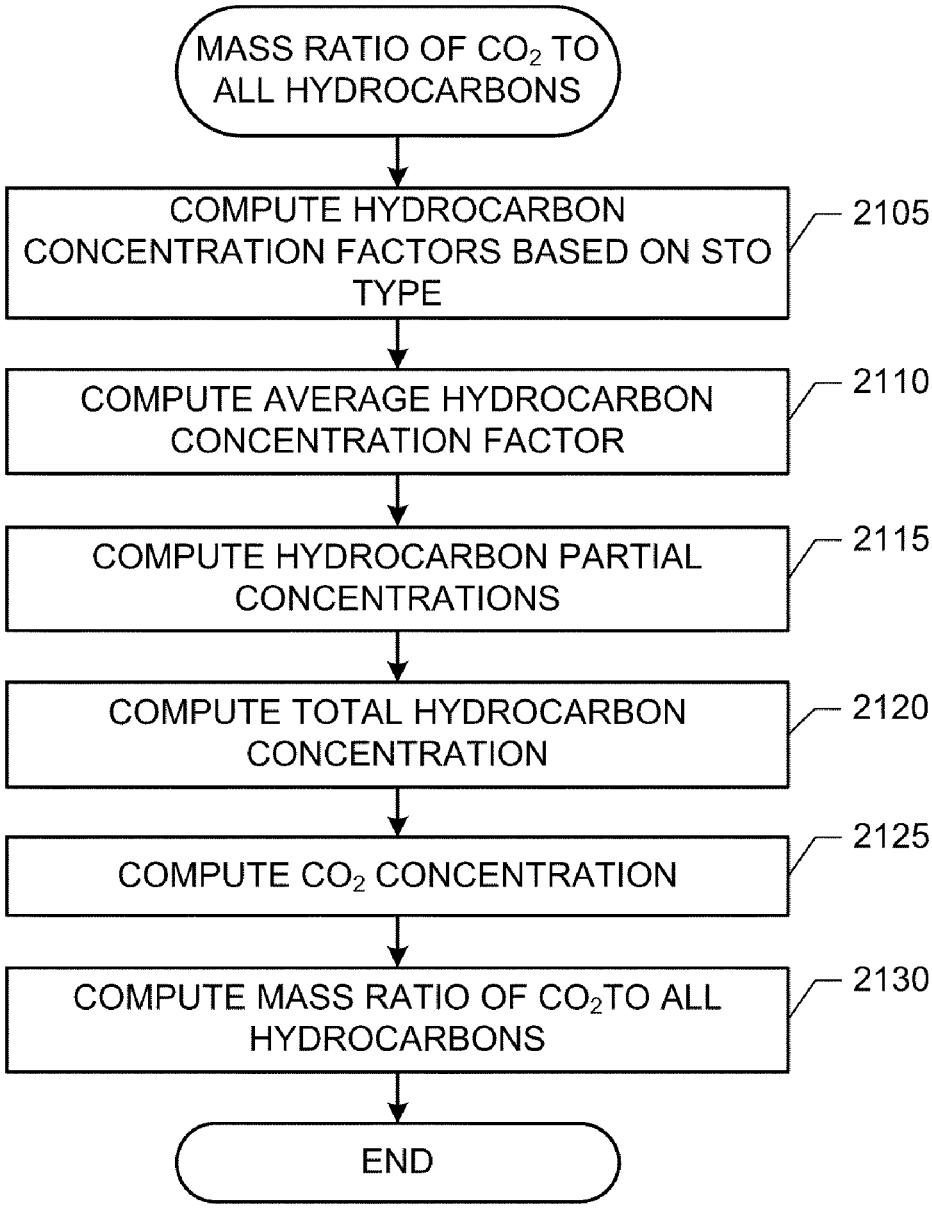
FIG. 21 is a flowchart representative of an example process that may be carried out to compute a mass ratio of $CO_2$ to all hydrocarbons (C1+).
Figure 22:
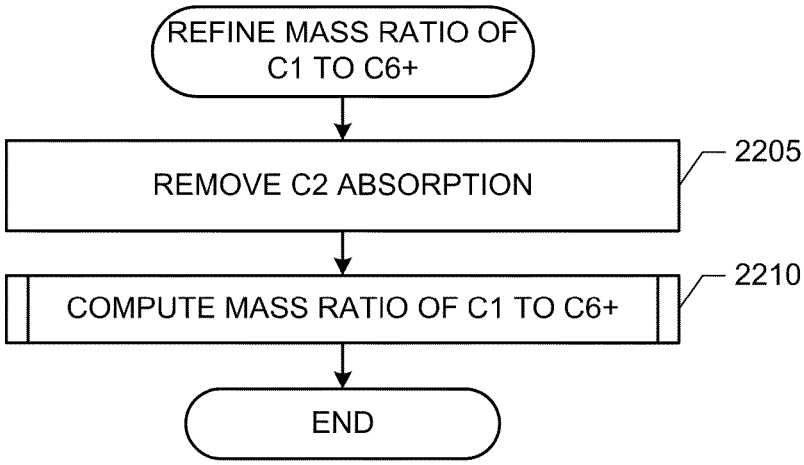
FIG. 22 is a flowchart representative of an example process that may be carried out to refine the estimate of the mass ratio of C1 to C6+.
Figure 23:
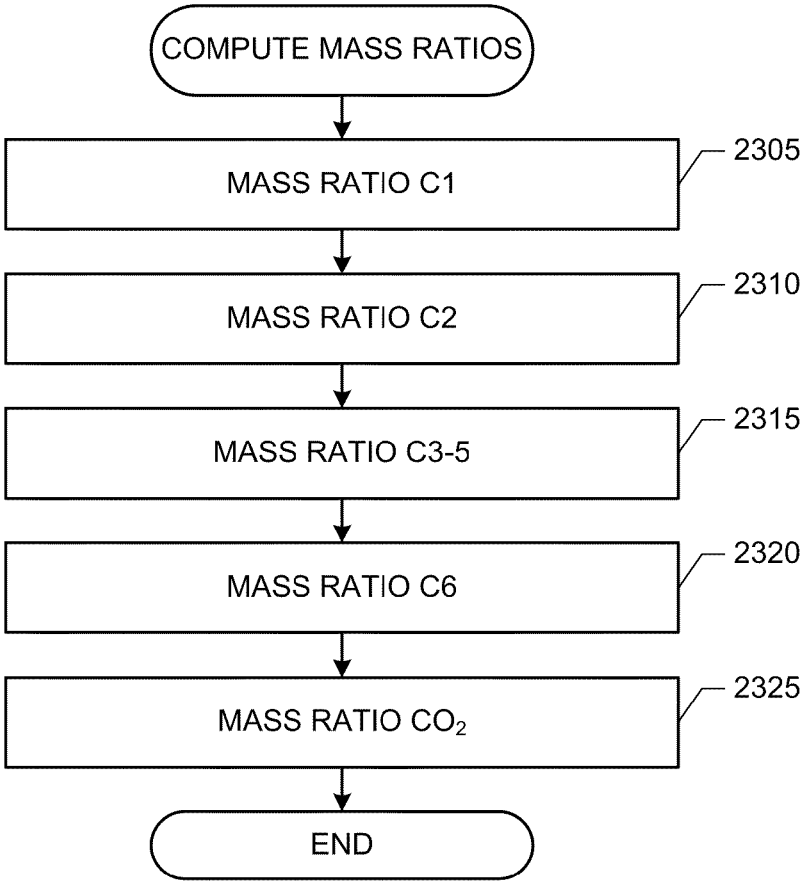
FIG. 23 is a flowchart representative of an example process that may be carried out to compute a mass ratio of C1, C2, C3-5, C6+ and $CO_2$ to all hydrocarbons plus $CO_2$.
Figure 24:
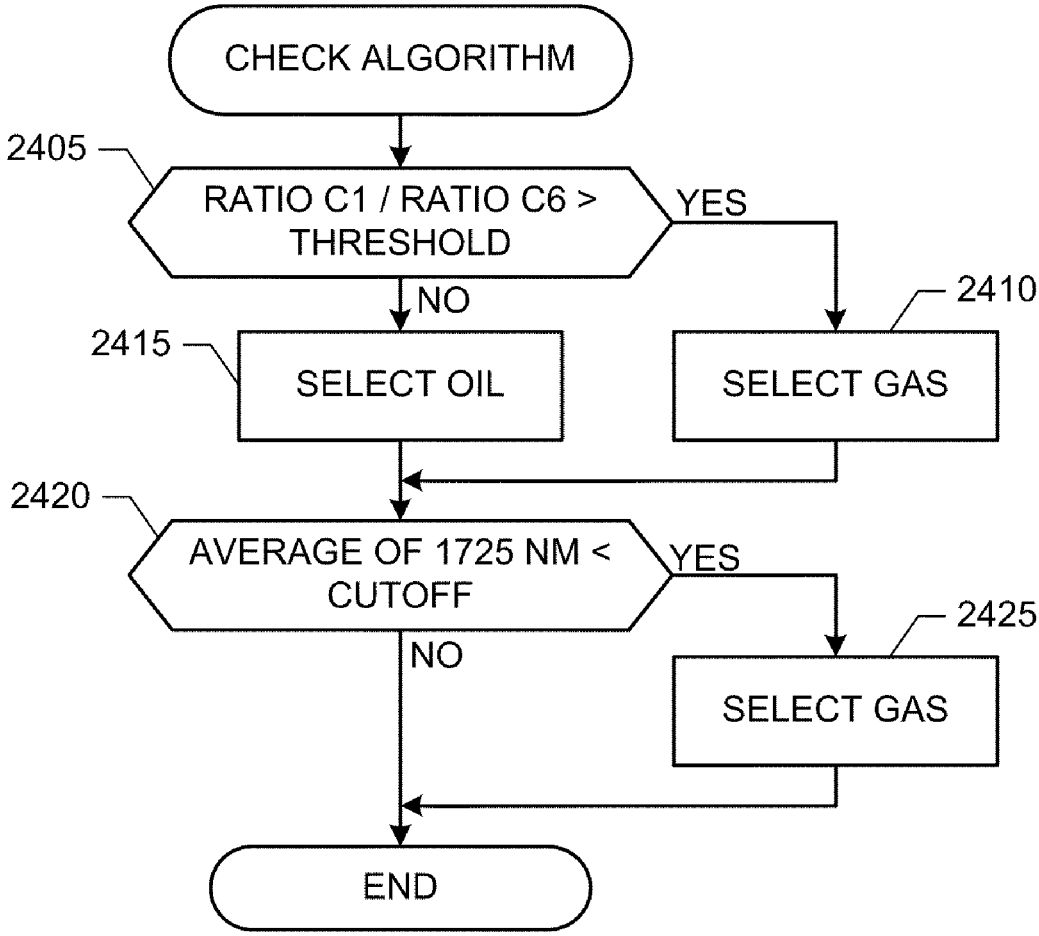
FIG. 24 is a flowchart representative of an example process that may be carried out to check the results of a fluid composition analysis.
Figure 25:
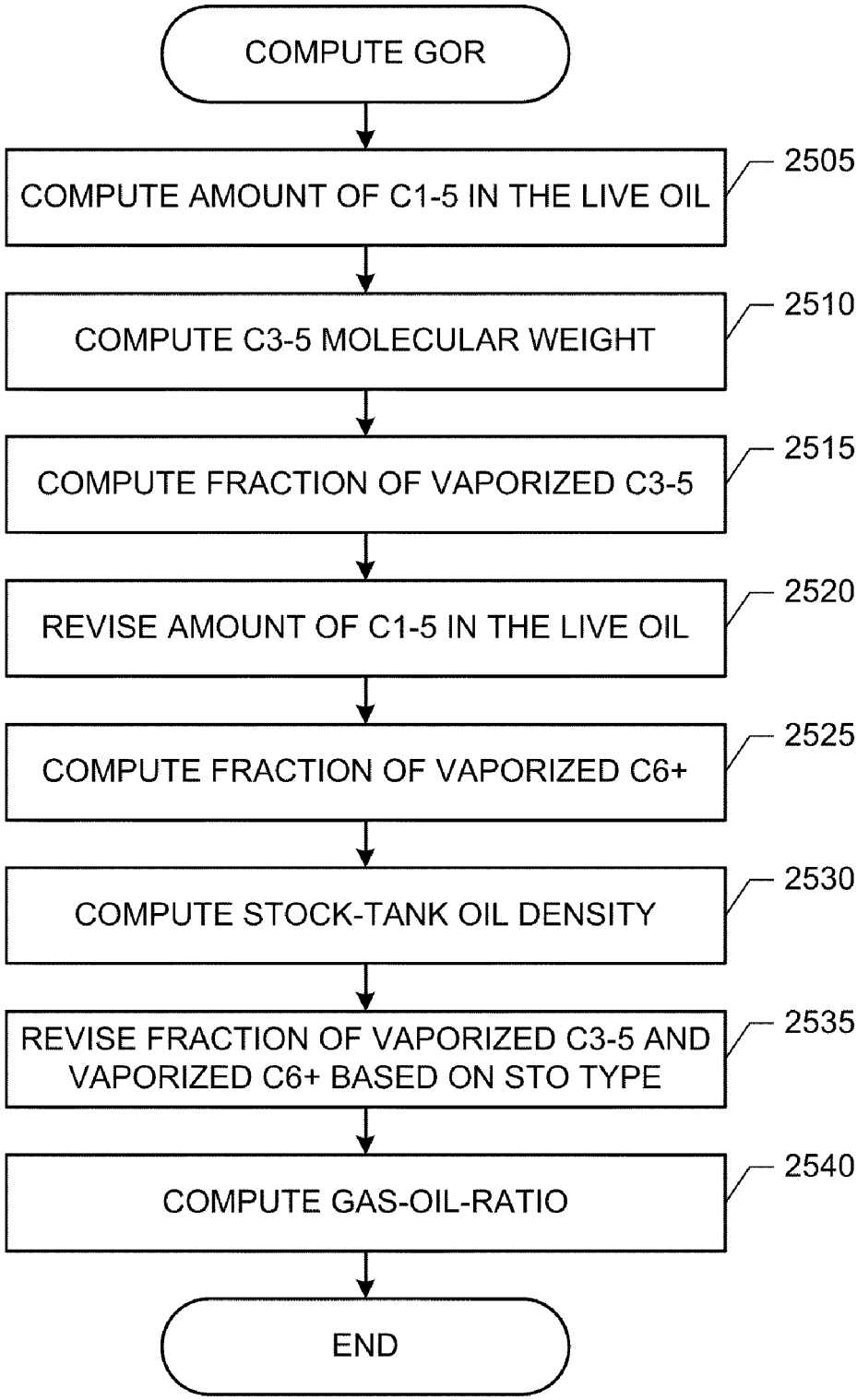
FIG. 25 is a flowchart representative of an example process that may be carried out to estimate a gas-oil-ratio (GOR) for a fluid associated with an underground geological formation based on a determined stock-tank oil type.

FIG. 12 is a flowchart representative of an example process that may be performed to implement the example sampling tool 101 of FIG. 1. FIG. 13 is a flowchart representative of an example process that may be performed to implement any or all of the example fluid analyzers 116 and 118 of FIGS. 1 and/or 2. FIG. 14 is a flowchart representative of an example process that may be carried out to estimate a mass ratio of C1 to C2 (i.e., C2, C3, . . . ). FIG. 15 is a flowchart representative of an example process that may be performed to implement the example stock-tank oil analyzer 225 of FIG. 2. FIG. 16 depicts example instructions that may be carried out to determine an STO type. FIG. 17 is a flowchart representative of an example process that may be carried out to compute a mass ratio of two components. FIG. 18 is a flowchart representative of an example process that may be carried out to remove the effect(s) of C1 absorptions. FIG. 19 is a flowchart representative of an example process that may be carried out to compute a mass ratio of C3-5 to C6+. FIGS. 20A and 20B are flowcharts representative of example processes that may be carried out to determine a $CO_2$ quality flag. FIG. 21 is a flowchart representative of an example process that may be carried out to computer a mass ratio of $CO_2$ to all hydrocarbons (C1+). FIG. 22 is a flowchart representative of an example process that may be carried out to refine the estimate of the mass ratio of C1 to C6+. FIG. 23 is a flowchart representative of an example process that may be carried out to compute mass ratios of C1, C2, C3-5, C6+ and $CO_2$ to all hydrocarbons plus $CO_2$. FIG. 24 is a flowchart representative of an example process that may be carried out to check the results of a fluid composition analysis. FIG. 25 is a flowchart representative of an example process that may be carried out to estimate a gas-oil-ratio (GOR) for a fluid associated with an underground geological formation based on a determined stock-tank oil type.

The example processes of FIGS. 12, 13, 14, 15, 17, 18, 19, 20A, 20B, 21, 22, 23, and/or 24, and/or the example instructions of FIG. 16 may be carried out by a processor, a controller and/or any other suitable processing device. For example, the example processes of FIGS. 12, 13, 14, 15, 17, 18, 19, 20A, 20B, 21, 22, 23, and/or 24, and/or the example instructions of FIG. 16 may be embodied in coded instructions stored on a tangible medium such as a flash memory, a read-only memory (ROM) and/or random-access memory (RAM) associated with a processor (e.g., the example processor 2605 discussed below in connection with FIG. 26). Alternatively, some or all of the example operations of FIGS. 12, 13, 14, 15, 17, 18, 19, 20A, 20B, 21, 22, 23, and/or 24, and/or the example instructions of FIG. 16 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, one or more the example operations of FIGS. 12, 13, 14, 15, 17, 18, 19, 20A, 20B, 21, 22, 23, and/or 24, and/or the example instructions of FIG. 16 may be implemented manually or as any combination of any of the foregoing techniques, for example, any combination of firmware, software, discrete logic and/or hardware, Further although the example processes of FIGS. 12, 13, 14, 15, 17, 18, 19, 20A, 20B, 21, 22, 23, and 24 are described with reference to the examples of FIGS. 12, 13, 14, 15, 17, 18, 19, 20A, 20B, 21, 22, 23, and/or 24, persons of ordinary skill in the art will readily appreciate that many other methods of implementing the processes of FIGS. 12, 13, 14, 15, 17, 18, 19, 20A, 20B, 21, 22, 23, and/or 24, and/or the example instructions of FIG. 16 may be employed. for example, the order of execution of the blocks may be changed, and/or one or more of the blocks described may be changed, eliminated, sub-divided, or combined. Additionally, persons of ordinary skill in the art will appreciate that any or all of the example operations of FIGS. 12, 13, 14, 15, 17, 18, 19, 20A, 20B, 21, 22, 23, and/or 24, and/or the example instructions of FIG. 16 may be carried out sequentially and/or carried out in parallel by, for example, separate processing threads, processors, devices, discrete logic, circuits, etc.

The example process of FIG. 12 begins with a fluid analyzer (e.g., any of the example fluid analyzers 116 and 118 of FIGS. 1 and/or 2) collecting OD values for a fluid sample (block 1205). The fluid analyzer (e.g., the example water fraction corrector 215 of FIG. 2) computes (e.g., estimates) the water volume fraction and then corrects for water content (block 1210). The fluid analyzer (e.g., the example decolorizer 220) performs decolorization of the water content corrected OD values (block 1215). The fluid analyzer (e.g., the example descatterer 222) then performs descattering of the water content corrected and/or color corrected OD values (block 1217).

The fluid analyzer estimates a mass ratio of C1 to C6+ by, for example, carrying out the example process of FIG. 17 for an assumed STO type (block 1220). The fluid analyzer then determines if the fluid sample should be analyzed for oil or gas (block 1222). For example, the fluid analyzer may use the mass ratio of C1 to C6+ computed at block 1220 to determine whether to analyze for oil or gas. In particular, if the mass ratio of C1 to C6+ is greater than a threshold, the fluid sample is analyzed for gas. If the fluid sample is to be analyzed for oil (block 1222), the fluid analyzer performs oil composition analysis by, for example, carrying out the example process of FIG. 13 (block 1225). If a result of the analysis performed at block 1225 confirms that the sample was principally composed of oil (block 1230), control proceeds to block 1255. if the result indicates that the sample was not principally composed of oil (block 1230), the fluid analyzer performs gas composition analysis (block 1235).

Returning to block 1222, if the fluid sample is to be analyzed for gas (block 1222), the fluid analyzer performs gas composition analysis (block 1240). If a result of the analysis performed at block 1240 confirms that the sample was principally composed of gas (block 1245), control proceeds to block 1255. If the result indicates that the sample was not principally composed of gas (block 1245), the fluid analyzer performs oil composition analysis by, for example, carrying out the example process of FIG. 13 (block 1250).

Continuing at block 1255, the fluid analyzer computers a GOR value by, for example, carrying out the example process of FIG. 25 (block 1255). The fluid analyzer then computes any type of quality flag that indicates the accuracy of the fluid analysis by performed by the fluid analyzer (block 1260). For example, the fluid analyzer may compare one or more computer values with one or more thresholds. The fluid analyzer (e.g., the example reporter 240 of FIG. 2) provides (e.g., outputs, logs, reports, stores, communicates, etc.) one or more values that were computed, estimated and/or determined by the fluid analyzer (block 1265). control then exits from the example process of FIG. 12.

The example process of FIG. 13 may be carried out to perform oil composition analysis. The example process of FIG. 13 computes (e.g., estimates) an STO type and then uses the estimated STO type during subsequent composition analysis. the example process of FIG. 13 determines the composition of a fluid sample sequentially, from the simplest component (e.g., C1) to the most complex component (e.g., C6+), and also estimates $CO_2$ concentration separately from other hydrocarbons.

The example process of FIG. 13 begins with a composition analyzer (e.g., the example composition analyzer 230 of FIG. 2) computing (e.g., estimating) a mass ratio of C1 to C2+ (i.e., C2, C3, . . . ) by, for example, carrying out the example process of FIG. 14 (block 1305). The example process continues with a stock-tank oil analyzer (e.g., the example stock-tank oil analyzer 225 of FIG. 2) determining (e.g., estimating) an STO type by, for example, carrying out the example process of FIG. 15 and/or by carrying out the example instructions of FIG. 16 (block 1310).

The composition analyzer estimates a mass ratio of C1 to C6+ by, for example, carrying out the example process of FIG. 17 (block 1315). The composition analyzer then removes the effects of C1 absorption by, for example, carrying out the example process of FIG. 18 (block 1320). The composition analyzer next computes a mass ratio of C2 to C6+ (block 1325) and a mass ratio of C3-5 to C6+ (block 1330) by, for example, carrying out the example process of FIG. 17 and FIG. 19, respectively.

The composition analyzer computes a flag indicative of the quality (e.g., estimated accuracy) of the $CO_2$ determination by, for example, carrying out the example processes of FIGS. 20A and 20B (block 1335). The composition analyzer computes a mass ratio of $CO_2$ to all hydrocarbons (C1+) by, for example, carrying out the example process of FIG. 21 (block 1340). The composition analyzer then refines the mass ratio of C1 to C6+ computed at block 1315 by, for example, carrying out the example process of FIG. 22 (block 1345).

The composition analyzer computes respective mass ratios of C1, C2, C3-5, C6+ and $CO_2$ to all hydrocarbons plus $CO_2$ by, for example, carrying out the example process of FIG. 23 (block 1350). The composition analyzer computes a flag that indicates whether oil or gas was the primary component of the fluid sample by, for example, carrying out the example process of FIG. 24 (block 1355). Control then exits from the example process of FIG. 13.

The example process of FIG. 14 may used to compute (e.g., estimate) a mass ratio of C1 to C2+. The example process of FIG. 14 begins with a composition analyzer (e.g., the example composition analyzer 230 of FIG. 2) computing a color absorption factor that represents the overall absorption of color at a number of wavelengths (e.g., 1070, 1290, 1500 and 1600 nm) (block 1405). Using any suitable method(s) and/or algorithm(s), the composition analyzer computes a response matrix $\overline{B}$ based on the color absorption factor for a set of filter-array channels (e.g., 1650 nm and 1725 nm after normalization by filter-array channel 1600 nm) (block 1410), inverts the matrix (block 1415), solves for the C1 and C20+ content based on the measured OD values for the filter-array channels (block 1420), and computes a mass ratio of R_FS based on the computed C1 and C2+ content values (block 1425).

Likewise, the composition analyzer computes a second response matrix $\hat{B}$ based on the color absorption factor for a set of grating channels (e.g., 1649 nm and 1725 nm after normalization by grating channel 1589 nm) (block 1430), inverts the second matrix (block 1435), solves for the C1 and C2+ content based on the measured OD values for the grating channels (block 1440), and computes a mass ratio R_GS based on the computed C1 and C2+ content values (block 1445). The composition analyzer then computes the average of the computed mass ratios R_FS and R_GS. Control then exits from the example process of FIG. 14.

The example process of FIG. 15 may used to determine (e.g., estimate) an STO type. The example process of FIG. 15 begins with a stock-tank oil analyzer (e.g., the example stock-tank oil analyzer 225 of FIG. 2) normalizing a live oil spectrum by channel 1740 nm and for C1 content by, for example, carrying out the example instructions 1605 of FIG. 16 (block 1505). The stock-tank oil analyzer then computes (e.g., estimates) the STO type by, for example, solving the example mathematical expression of EQN (1) and/or carrying out the example instructions 1610 of FIG. 16 (block 1510). Control then exits from the example process of FIG. 15.

The example process of FIG. 17 may be used to compute (e.g., estimate) a mass ratio of two components (e.g., C1 to C6+, C2 to C6+, C2-5 to C6+, etc.). The example process of FIG. 17 begins with a composition analyzer (e.g., the example composition analyzer 230 of FIG. 2) computing a response matrix based on a color absorption factor and an STO type (block 1705). For example, the STO type may be used to scale a response value of the response matrix based upon the percentage of waxy STO versus branched-alkane type STO present in the fluid sample.

The composition analyzer inverts the response matrix (block 1710), solves for the component 1 content (e.g., C1 content) and component 2 content (e.g., C6+ content) based on the measured OD values for a channel (e.g., filter-array, grating and/or otherwise) (block 1715), and computes a mass ratio based on the computed component 1 and component 2 content values (block 1720). The composition analyzer adds the computed mass ratio to a sum of mass ratios (block 1725).

If more channels remain to be processed (block 1730), control returns to block 1715 to process the next channel. If all channels have been processed (block 1730), an average mass ratio is computed by dividing the sum of mass ratios by the number of channels processed (block 1735). Control then exits from the example process of FIG. 17.

Persons of ordinary skill in the art will readily appreciate that the example process of FIG. 17 may be used to determine mass ratios for various combinations of components. Moreover, the particular channels used to compute one mass ratio (e.g., C1 to C6+) may be different than the channels used to compute a different mass ratio (e.g., C3-5 to C6+). Further, a response matrix used and/or values used to compute the response matrix at block 1705 may depend upon the particular components being analyzed by the example process of FIG. 17. Such response matrices and/or values used to compute the same may be determined analytically (e.g., computed using mathematical equations) and/or determined experimentally (e.g., by taking one or more measurements of fluid samples having known compositions and/or characteristics). Further still, differences of each channel (e.g., at wavelengths of 1649 nm, 1725 nm, etc.) to a common base channel (e.g., at 1600 nm or 1589 nm) may be used when solving for component 1 and component 2 content.

The example process of FIG. 18 may be used to remove C1 absorptions. The example process of FIG. 18 begins with a composition analyzer (e.g., the example composition analyzer 230 of FIG. 2) computing (e.g., estimating) the amount of C1 absorption (CA) at, for example, filter-array channel 1650 nm using the following mathematical expression (block 1805).

$$CA = \frac{(\text{FSOD_DC}[1650] - \text{FSOD_DC}[1600]) * \frac{MR_{C1/C2+}}{1 + MR_{C1/C2+}} * C1_f_FS[1650]}{\left(\frac{MR_{C1/C2+}}{1 + MR_{C1/C2+}} * C1_f_FS[1650] + \frac{1}{1 + MR_{C1/C2+}} * (\text{OD_FS1650_f1} - \text{STO_TYPE} * \text{OD_FS1650_f2})\right)} \quad \text{EQN (2)}$$

where C1_f_FS[] characterizes C1 absorption at particular wavelengths, OD_FS1650_f1 equals 0.03, OD_FS1650_f2=0.01, FSOD_DC[] values represent decolorized filter-array channel OD values, STO_TYPE is a value representative of an STO type value, and $MR_{C1/C2+}$ is a mass ratio of C1 to C2+. The values of C1_f_FS[] may be determined analytically (e.g., computed using mathematical equations) and/or determined experimentally (e.g., by taking one or more measurements of fluid samples having known compositions and/or characteristics).

The composition analyzer then removes the C1 absorption from each measured channel (block 1810). For example, for decolorized filter-array channels $\text{FSOD_DC}_{orig}[]$, C1 absorption (CA) (e.g., computed using EQN (2)) may be removed using the mathematical expression shown below, where of C1_f_FS[] characterizes C1 absorption at particular wavelengths, and the subscripts orig and new represent decolorized filter-array channel OD values pre and post C1 absorption correction, respectively.

$$\text{FSOD_DC}_{new}[i] = \text{FSOD_DC}_{orig}[i] - \text{FSOD_DC}[1600] - \frac{CA * C1_f_FS[i]}{C1_f_FS[1650]} \quad \text{EQN (3)}$$

Control then exits from the example process of FIG. 18.

The example process of FIG. 19 may be used to compute (e.g., estimate) a mass ratio of C3-5 to C6+. The example process of FIG. 19 begins with a composition analyzer (e.g., the example composition analyzer 230 of FIG. 2) computing (e.g., estimating) the mass ratio of C2-5 to C6+ by, for example, carrying out the example process of FIG. 17 (block 1905). The composition analyzer then computes the mass ratio of C3-5 to C6+ by computing a difference of the computed mass ratio of C2-5 to C6+ and a computed mass ratio of C2 to C6+ (e.g., computed at block 1325 of FIG. 13) (block 1910). Control then exits from the example process of FIG. 19.

The example processes of FIGS. 20A and 20B may be used to determine (e.g., compute) a flag indicative of the quality (e.g., estimated accuracy) of the $CO_2$ determination. The example process of FIG. 20A begins with a composition analyzer (e.g., the example composition analyzer 230 of FIG. 2) computing a first flag CO2_Q1 based on a water fraction value by, for example, carrying out the example process of FIG. 20B (block 2005). Water fraction values may be computed using, for example, the effective flow stream (EFS) model. An example method for computing water fraction values is described in the paper entitled "In-Situ Optical Fluid Analysis as an Aid to Wireline Formation Sampling," by Smits et al, published in SPE Formation Evaluation, June 1995, pp. 91-98, and incorporated herein by reference in its entirety. The composition analyzer then computes a second flag $CO_2_Q_2$ based upon a water difference value by, for example, carrying out the example process of FIG. 20B (block 2010). The composition analyzer then selects the minimum of the CO2_Q1 and CO2_Q2 flags (block 2015). The thresholds used at blocks 2005 and 2010 may be different. For example, the flag CO2_Q1 may be determined using a first set of thresholds and the flag CO2_Q2 may be determined using a second set of thresholds. Control then exits from the example process of FIG. 20A.

The example process of FIG. 20B begins with a composition analyzer (e.g., the example composition analyzer 230 of FIG. 2) comparing a value (e.g., a water fraction value or a water difference value) with a first threshold (e.g., 0.025) (block 2020). If the value is less than the first threshold (block 2020), the flag is set to HIGH (block 2025). If the value equals or exceeds the first threshold (block 2020), the value is compared to a second threshold (e.g. 0.05) (block 2030). If the value is less than the second threshold (block 2030), the flag is set to MEDIUM (block 2035). If the value equals or exceeds the second threshold (block 2030), the value is compared to a third threshold (e.g., 0.1) (block 2040). If the value is less than the third threshold (block 2040), the flag is set to LOW (block 2045). If the value equals or exceeds the third threshold (block 2040), the flag is set to NO COMPUTE (block 2050). Once the flag is set, control returns from the example process of FIG. 20B to, for example, the example process of FIG. 20A at block 2005 and/or block 2010. Persons of ordinary skill in the art will readily appreciate that the threshold values used at blocks 2020, 2030 and/or 2040 may depend and/or be selected based on the type of value (e.g., water fraction or water difference) being used by the example process of FIG. 20B to determine the quality flag.

The example process of FIG. 21 may be used tom compute (e.g., estimate) a mass ratio of $CO_2$ to all hydrocarbons. The example process of FIG. 21 begins with a composition analyzer (e.g., the example composition analyzer 230 of FIG. 2) computing hydrocarbon concentration factors for a filter-array channel (e.g., at 1725 nm) and a grating channel (e.g., at 1725 nm) (block 2105). For example, a hydrocarbon concentration factor for the 1725 nm filter-array channel ($f_{HYD}$) can be computed using EQN (4), where STO_Type is a value representative of an STO type FSOD_DC[] values represent decolorized filter-array channel OD values, $MR_{C1/C6}$, is a mass ratio of C1 to C6+, $MR_{C2/C6+}$ is a mass ratio of C2 to C6+, and $MR_{C3\text{-}5/C6}$+ is a mass ratio of C3-5 to C6+.

$$f_{HYD} = \frac{\text{FSOD_DC}[1725] - \text{FSOD_DC}[1600]}{\frac{0.5 \times MR_{C1/C6+}}{1 + MR_{C1/C6+} + MR_{C2/C6+} + MR_{C3-5/C6+}} + \left(1 - \frac{MR_{C1/C6+}}{1 + MR_{C1/C6+} + MR_{C2/C6+} + MR_{C3-5/C6+}}\right) \times (0.7015 + 0.1123 \times \text{STO_Type})} \quad \text{EQN (4)}$$

The composition analyzer then computes an average hydrocarbon concentration factor from the factors computed at block 2105 (block 2110).

Using any suitable algorithm(s) and/or method(s), the composition analyzer next computes the concentrations of the various components (e.g., C1, C2, C3, C6, etc.) (block 2115) and computes the total concentration of hydrocarbons based on the partial concentrations (block 2120). The composition analyzer also computes the concentration of $CO_2$ (block 2125). For example, the composition analyzer may remove the absorptions of hydrocarbons from two difference channels (e.g., FSOD[2010]−FSOD[1985] and FSOD [2010]−FSOD[2040]) to estimate the concentration of $CO_2$ for the two difference channels. Based on the partial concentrations computed at block 2115 and the concentrations of $CO_2$ for the two difference channels, the composition analyzer computes the mass ratio of $CO_2$ to all hydrocarbons (block 2130). For example, the mass ratio of $CO_2$ to C1+ may be computed using the following mathematical equation.

$$MR_{CO_2/C1+} = \frac{0.3\times 2.2\times \rho_{CO_2_2010-1985} + 0.7\times 2.1\times \rho_{CO_2_2010-2040}}{\rho_{C1}+\rho_{C2}+\rho_{C3-5}+\rho_{C6+}} \quad \text{EQN (5)}$$

where the values of $\rho_x$ are the various partial concentrations, $\rho_{CO2_2010-1985}$ is the $CO_2$ concentration computed from the difference channel FSOD[2010]−FSOD[1985], and $\rho_{CO2_2010-2040}$ is the $CO_2$ concentration computed from the difference channel FSOD[2010]−FSOD[2040]. Control then exits from the example process of FIG. 21.

The example process of FIG. 22 may be used to refine the mass ratio of C1 to C6+ (e.g., computed at block 1315 of FIG. 13). The example process of FIG. 22 begins with a composition analyzer (e.g., the example composition analyzer 230 of FIG. 2) using any suitable algorithm(s) and/or method(s) to remove the effects of C2 absorption from a grating channel at 1665 nm (block 2205). The composition analyzer then computes the mass ratio of C1 to C6+ based on the grating channel at 1665 nm with C2 absorptions removed by, for example, carrying out the example process of FIG. 17 (block 2210). Control then exits from the example process of FIG. 22.

The example process of FIG. 23 may be used to compute the mass ratio of C1, C2, C3-5, C6+ and $CO_2$ to all hydrocarbons plus $CO_2$. The example process of FIG. 23 begins with a composition analyzer (e.g., the example composition analyzer 230 of FIG. 2) computing (e.g., estimating) the mass ratio of C1 to all hydrocarbons plus $CO_2$ using, for example EQN (6) (block 2305), and the mass ratio of C2 to all hydrocarbons plus $CO_2$ using, for example EQN (7) (block 2310). The composition analyzer then computes the mass ratio of C3-5 to all hydrocarbons plus $CO_2$ using, for example EQN (8) (block 2315), the mass ratio of C6 to all hydrocarbons plus $CO_2$ using, for example EQN (9) (block 2320), and the mass ratio of $CO_2$ to all hydrocarbons plus $CO_2$ using, for example EQN (10) (block 2325). In the example equations EQN(6), EQN(7), EQN(8), EQN(9) and EQN(10),), $MR_{C1/C6+}$ is a mass ratio of C1 to C6+, $MR_{C2/C6+}$ is a mass ratio of C2 to C6+, $MR_{C3\text{-}5/C6+}$ is a mass ratio of C3-5 to C6+, $MR_{CO2/C6+}$ is a mass ratio of $CO_2$ to C6+, and $MR_{CO2/C1+}$ is a mass ratio of $CO_2$ to C1+. Control then exits from the example process of FIG. 23.

$$R_{C1} = \frac{MR_{C1/C6+}}{(1+MR_{C1/C6+}+MR_{C2/C6+}+MR_{C3-5/C6+})(1+MR_{CO_2/C1+})} \quad \text{EQN (6)}$$

$$R_{C2} = \frac{MR_{C2/C6+}}{(1+MR_{C1/C6+}+MR_{C2/C6+}+MR_{C3-5/C6+})(1+MR_{CO_2/C1+})} \quad \text{EQN (7)}$$

$$R_{C3-5} = \frac{MR_{C3-5/C6+}}{(1+MR_{C1/C6+}+MR_{C2/C6+}+MR_{C3-5/C6+})(1+MR_{CO_2/C1+})} \quad \text{EQN (8)}$$

$$R_{C6+} = \frac{1}{(1+MR_{C1/C6+}+MR_{C2/C6+}+MR_{C3-5/C6+})(1+MR_{CO_2/C1+})} \quad \text{EQN (9)}$$

$$R_{CO_2} = \frac{MR_{CO_2/C1+}}{(1+MR_{CO_2/C1+})} \quad \text{EQN (10)}$$

The example process of FIG. 24 may be used to check that fluid sample was correctly analyzed for oil or gas. The example process of FIG. 24 begins with a composition analyzer (e.g., the example composition analyzer 230 of FIG. 2) computing and then comparing to a threshold the ratio of the mass ratio of C1 to all hydrocarbons to the mass ratio of C6 to all hydrocarbons (block 2405). If the ratio exceeds the threshold (block 2405), the fluid sample is selected for gas analysis (block 2410). If the ratio does not exceed the threshold (block 2405), the fluid sample is selected for oil analysis (block 2415).

If the average of the OD values taken at 1725 nm, after correction for water fraction, is less than a cutoff (e.g., 0.1) (block 2420), the fluid sample is selected for gas analysis (block 2425). Once a selection for oil or gas analysis has been made, control exits form the example process of FIG. 24.

The example process of FIG. 25 may be used to compute a gas-oil-ratio based on STO type. The example process of FIG. 25 begins with a composition analyzer (e.g., the example composition analyzer 230 of FIG. 2) computing (e.g., estimating) the amount of C1-5 in the live oil (block 2505), and computing the C3-5 molecular weight (block 2510). The composition analyzer then computes the fraction of vaporized C3-5 present in the fluid sample (block 2515), and revises the amount of C1-5 in the live oil (block 2520).

The composition analyzer continues by computing the fraction of vaporized C6+ (block 2525) and computing the density of the stock-tank oil (block 2530). Based on the STO type, the composition analyzer updates the fraction of vaporized C3-5 and vaporized C6+ (block 2535). For example, the fraction of vaporized C3-5 and vaporized C6+ may be computed using the mathematical expressions of EQN (11) and EQN (12). In equation EQN(11), STO_Type is a value representative of an STO type. In equation EQN (12), Raw- _Color is a value representative of fluid coloration. For example, it may be computed as a sum of the filter channels at 1070 nm, 1290 nm and 1500 nm after subtraction of the filter channel at 1600 nm. Based on the vaporized fractions, the composition analyzer computes the GOR for the fluid sample using, for example, EQN (13) (block 2540). In equations EQN(11), EQN(12) and EQN(13), the values $R_x$ represent mass ratios of respective components to all hydrocarbons plus $CO_2$ and may be computed, for example, by using EQN(6), EQN(7), EQN(8), EQN(9) and/or EQN(10). Control then exits from the example process of FIG. 25.

$$\eta_{R_C3-5} = \left(1 - \frac{3.15}{100 \times \left(\frac{R_{C1}}{16.04} + \frac{R_{C2}}{30.07}\right)}\right) \times (1 - 0.1280 \times \text{STO_Type}) \quad \text{EQN (11)}$$

$$\eta_{R_C6+} = 0.0314 \times \left(\frac{R_{C1}}{16.04} + \frac{R_{C2}}{30.07} + \frac{R_{C3-5}}{69.82} \times \eta_{C3-5} + \frac{R_{CO_2}}{44}\right) \times (1 + 1.166 \times \text{Raw_Color}) \quad \text{EQN (12)}$$

$$GOR = 113076 \times \frac{\frac{R_{C1}}{16.04} + \frac{R_{C2}}{30.07} + \frac{R_{C3-5}}{69.82} \times \eta_{R_C3-5} + \frac{R_{C6+}}{110.0} \times \eta_{R_C6+} + \frac{R_{CO_2}}{44.0}}{R_{C3-5}(1 - \eta_{R_C3-5}) + R_{C6+}(1 - \eta_{R_C6+})} (scf/stb) \quad \text{EQN (13)}$$

Figure 26:
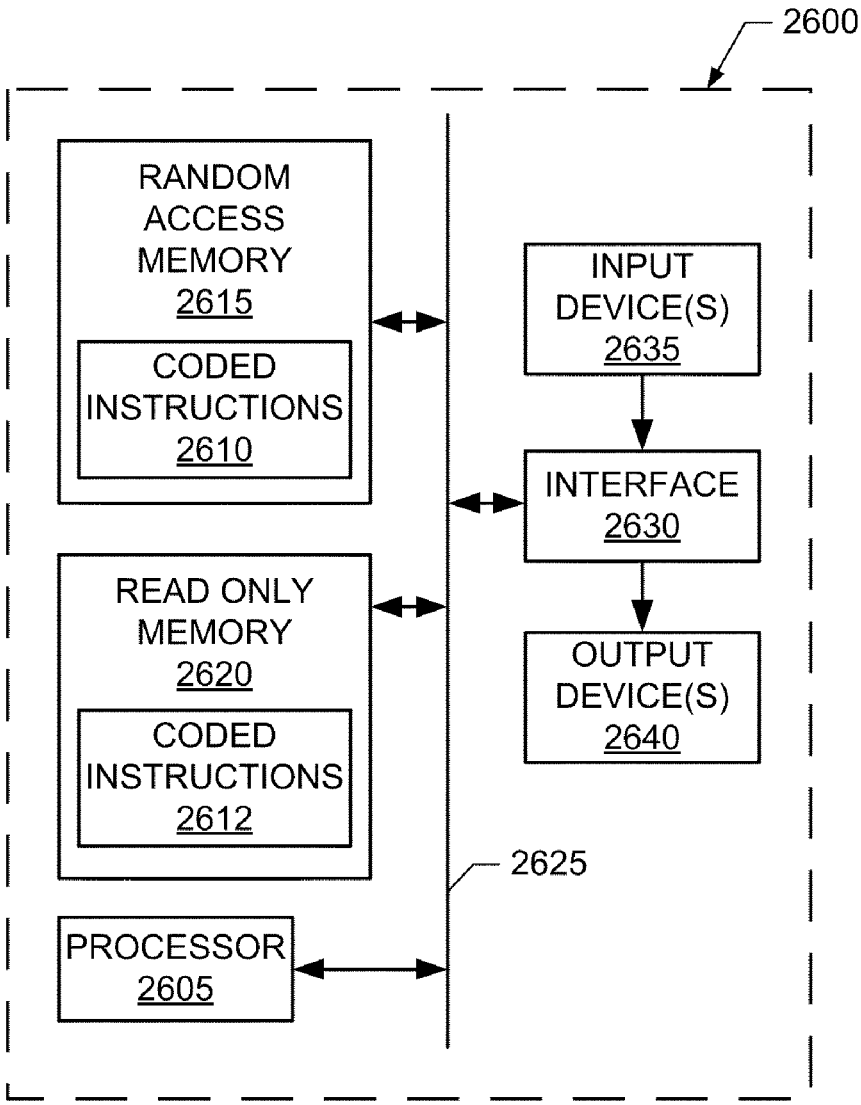
FIG. 26 is a schematic illustration of an example processor platform that may be used and/or programmed to perform any or all of the example processes, the example apparatus and/or the example methods described herein.

FIG. 26 is a schematic diagram of an example processor platform 2600 that may be used and/or programmed to implement any portion of the example sampling tool 101 and/or the fluid analyzers 116 and 118 described herein. For example, the processor platform 2600 can be implemented by one or more general purpose processors, processor cores, microcontrollers, etc.

The processor platform 2600 of the example of FIG. 26 includes at least one general purpose programmable processor 2605. The processor 2605 executes coded instructions 2610 and/or 2612 present in main memory of the processor 2605 (e.g., within a RAM 2615 and/or a ROM 2620). The processor 2605 may be any type of processing unit, such as a processor core, a processor and/or a microcontroller. The processor 2605 may execute, among other things, the example processes of FIGS. 12, 13, 14, 15, 17, 18, 19, 20A, 20B, 21, 22, 23, 24 and/or 25, and/or the example instructions of FIG. 16 to implement any or all of the example sampling tool 101 and/or the example fluid analyzers 116 and 118 described herein. The processor 2605 is in communication with the main memory (including a ROM 2620 and/or the RAM 2615) via a bus 2625. The RAM 2615 may be implemented by DRAM, SDRAM, and/or any other type of RAM device, and ROM may be implemented by flash memory and/or any other desired type of memory device. Access to the memory 2615 and 2620 may be controlled by a memory controller (not shown). The RAM 2615 may be used to store and/or implement, for example, measured OD values.

The processor platform 2600 also includes an interface circuit 2630. The interface circuit 2630 may be implemented by any type of interface standard, such as a USB interface, a Bluetooth interface, an external memory interface, serial port, general purpose input/output, etc. One or more input devices 2635 and one or more output devices 2640 are connected to the interface circuit 2630. The input devices 2635 and/or output devices 2640 may be used to receive measured OD values and/or to output result(s) of fluid composition analyses.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method to characterize a fluid associated with an underground geological formation, the method comprising:

obtaining a sample comprising the fluid associated with the underground geological formation;

measuring, in a borehole associated with the underground geological formation, an optical property of the fluid, wherein the optical property is measured by a grating spectrometer and filter-array spectrometer;

determining, in the borehole, a stock-tank oil type for the sample associated with the underground geological formation, wherein the stock-tank oil type is determined based on the optical property; and determining a property of the sample associated with the underground geological formation based on the stock-tank oil type.

2. A method as defined in claim 1, wherein determining the stock-tank oil type for the fluid associated with the underground geological formation comprises:

transmitting light to the fluid;

measuring an effect on the transmitted light caused by the fluid; and comparing the measured effect to two or more reference effects for hydrocarbon types to determine the stock-tank oil type.

3. A method as defined in claim 2, wherein the measured effect is a light absorption.

4. A method as defined in claim 1, wherein the stock-tank oil type represents a fraction of the fluid that is a waxy stock-tank oil.

5. A method as defined in claim 1, wherein the stock-tank oil type represents a fraction of the fluid that is a branched alkane stock-tank oil.

6. A method as defined in claim 1, wherein the optical property comprises a light absorption spectrum, and further comprising normalizing the spectrum based upon the absorption measured at about 1740 nanometers.

7. A method as defined in claim 6 further comprising correcting the spectrum for the methane content.

8. A method as defined in claim 1, further comprising:

measuring one or more optical densities of the fluid at one or more wavelengths; and computing a normalized live oil spectrum based on the one or more measured optical densities, wherein the stock-tank oil type is determined based on the normalized live oil spectrum.

9. A method as defined in claim 8, wherein the one or more wavelengths are between about 1725 nanometers and 1814 nanometers.

10. A method as defined in claim 1, wherein the property of the fluid is one of a gas-oil-ratio (GOR) value, a mass ratio and a partial density.

11. A method as defined in claim 1, wherein the property of the fluid is representative of the composition of the fluid.

12. A method as defined in claim 1, further comprising logging at least one of the determined stock-tank oil type or the determined fluid property.

13. An apparatus to characterize a fluid associated with an underground geological formation, the apparatus comprising:

a device to obtain a sample of the fluid associated with the underground geological formation;

an optical sensor to measure an optical property of the sample of the fluid;

an analyzer to determine a stock-tank oil type for the sample of the fluid based on the optical property;

a grating spectrometer; and a filter-array spectrometer.

14. An apparatus as defined in claim 13, wherein the optical sensor is to be operated in a borehole associated with the underground geological formation.

15. An apparatus as defined in claim 13, wherein the analyzer is to determine at least one of a gas-oil-ratio or a mass ratio based on the stock-tank oil type.

16. An apparatus as defined in claim 13, wherein the stock-tank oil type represents a fraction of the sample of the fluid that is a waxy stock-tank oil.

17. An apparatus as defined in claim 13, wherein the stock-tank oil type represents a fraction of the sample of the fluid that is a branched-alkane stock-tank oil.

18. An apparatus as defined in claim 13, wherein the optical sensor measures the optical property at a wavelength between about 1725 nanometers and 1814 nanometers.

19. A method comprising:

transmitting light to a sample of an underground geological formation;

measuring an indication of absorption of the transmitted light by the sample; and comparing the measured indication of absorption to two or more absorptions for respective ones of two or more hydrocarbon types to determine a parameter of the sample, wherein the two or more hydrocarbon types include at least a waxy hydrocarbon and a non-waxy hydrocarbon.

20. A method as defined in claim 19, wherein the parameter of the sample is a stock-tank oil type.

21. A method as defined in claim 20, wherein the stock-tank oil type represents one of a fraction of the sample comprising a waxy stock-tank oil and a fraction of the sample comprising a branched alkane stock-tank oil.

22. A method as defined in claim 20, further comprising determining a second parameter of the sample based on the stock-tank oil type.

23. A method as defined in claim 22, wherein the second parameter is as gas-oil-ratio (GOR) value.

24. A method as defined in claim 19, wherein the sample is a fluid sample, and wherein measuring the indication of absorption of the light by the sample comprises measuring a portion of the light that passes through the sample.

25. A method as defined in claim 19, wherein the sample includes a surface of the underground geological formation, and wherein measuring the indication of absorption of the light by the sample comprises measuring a reflection of the light by the sample.

* * * * *